US012601024B2

(12) United States Patent
Romero Reséndiz et al.

(10) Patent No.: US 12,601,024 B2
(45) Date of Patent: Apr. 14, 2026

(54) HETEROSTRUCTURED ANTIMICROBIAL STAINLESS STEEL AND METHOD FOR SYNTHESIZING THE SAME

(71) Applicant: City University of Hong Kong, Hong Kong (HK)

(72) Inventors: Liliana Romero Reséndiz, Hong Kong (HK); Yuntian Theodore Zhu, Hong Kong (HK); Jacob Chih-Ching Huang, Hong Kong (HK); Tao Yang, Hong Kong (HK)

(73) Assignee: City University of Hong Kong, Hong Kong (HK)

( * ) Notice: Subject to any disclaimer, the term of this patent is extended or adjusted under 35 U.S.C. 154(b) by 517 days.

(21) Appl. No.: 18/161,907

(22) Filed: Jan. 31, 2023

(65) Prior Publication Data

US 2024/0254581 A1 Aug. 1, 2024

(51) Int. Cl.
*C21D 8/00* (2006.01)
*C21D 1/18* (2006.01)
(Continued)

(52) U.S. Cl.
CPC ..... *C21D 8/00* (2013.01); *C21D 1/18* (2013.01); *C21D 6/004* (2013.01); *C21D 6/005* (2013.01);
(Continued)

(58) Field of Classification Search
CPC ..... C21D 1/18; C21D 6/004; C21D 6/005; C21D 6/02; C21D 8/005; C21D 6/008;
(Continued)

(56) References Cited

U.S. PATENT DOCUMENTS 6,312,533 B1 11/2001 Yokota et al.
9,719,160 B1 8/2017 Gojny et al.

FOREIGN PATENT DOCUMENTS

CN 106756613 A 5/2017
CN 108842115 A 11/2018
(Continued)

OTHER PUBLICATIONS

Berns, H., Gavriljuk, V. and Shanina, B. Intensive Interstitial Strengthening of Stainless Steels. Adv. Eng. Mater., 10: 1083-1093. https://doi.org/10.1002/adem.200800214 (Year: 2008).*
(Continued)

*Primary Examiner* — Tima M. McGuthry-Banks
(74) *Attorney, Agent, or Firm* — Idea Intellectual Limited; Sam T. Yip

(57) ABSTRACT

A heterostructured antimicrobial stainless steel with improved yield strength and reduced strength-to-ductility trade-off and methods for synthesizing the same are provided. The heterostructured antimicrobial stainless steel has a plurality of mechanically strengthening mechanisms including: interstitial solid solution alloying elements; substitutional solid solution alloying elements; twins; multiphasic interfaces formed with face-centered cubic austenite phase and body-centered cubic martensite phase; statistically stored dislocations; strain-induced phase transformation; geometrically necessary dislocations pile-ups; stacking faults; precipitates; high density of grain boundaries; and HDI strengthening.

19 Claims, 20 Drawing Sheets

(51) Int. Cl.

| | |
|---|---|
| ***C21D 6/00*** | (2006.01) |
| ***C21D 6/02*** | (2006.01) |
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/42*** | (2006.01) |
| ***C22C 38/44*** | (2006.01) |
| ***C22C 38/58*** | (2006.01) |

(52) U.S. Cl.
CPC ..... *C21D 6/008* (2013.01); *C21D 6/02* (2013.01); *C21D 8/0221* (2013.01); *C21D 8/0236* (2013.01); *C21D 8/0273* (2013.01); *C22C 38/002* (2013.01); *C22C 38/02* (2013.01); *C22C 38/42* (2013.01); *C22C 38/44* (2013.01); *C22C 38/58* (2013.01); *C21D 2211/001* (2013.01); *C21D 2211/008* (2013.01)

(58) Field of Classification Search
CPC .. C21D 8/0221; C21D 8/0236; C21D 8/0273; C21D 2211/001; C21D 2211/008; C22C 38/42; C22C 38/44; C22C 38/58; C22C 38/002; C22C 38/02
See application file for complete search history.

(56) References Cited

FOREIGN PATENT DOCUMENTS

JP 2015048500 A * 3/2015
WO WO-2021204811 A1 * 10/2021 ..... C22C 38/16

OTHER PUBLICATIONS

JP-2015-048500-A machine translation (Year: 2015).*
Li, J., Cao, Y., Gao, B. et al. Superior strength and ductility of 316L stainless steel with heterogeneous lamella structure. J Mater Sci 53, 10442-10456. https://doi.org/10.1007/s10853-018-2322-4 (Year: 2018).*
Arora, H.S., Ayyagari, A., Saini, J. et al. High Tensile Ductility and Strength in Dual-phase Bimodal Steel through Stationary Friction Stir Processing. Sci Rep 9, 1972. https://doi.org/10.1038/s41598-019-38707-3 (Year: 2019).*
N Ali Marwan et al 2021 IOP Conf. Ser.: Mater. Sci. Eng. 1067. https://doi.org/10.1088/1757-899X/1067/1/012142 (Year: 2020).*
I.T. Hong, C.H. Koo, Antibacterial properties, corrosion resistance and mechanical properties of Cu-modified SUS 304 stainless steel, Mater. Sci. Eng. A. 393 (2005) 213-222.
J. Li, Y. Cao, B. Gao, Y. Li, Y. Zhu, Superior strength and ductility of 316L stainless steel with heterogeneous lamella structure, J. Mater. Sci. 53 (2018) 10442-10456.
K.K. Chen, C.Y. Chao, J.H. Chen, J.H. Wu, Y.H. Chang, J.K. Du, Effect of low copper addition to as-forged 304 stainless steel for dental applications, Metals (Basel). 11 (2021) 1-8.
M. Marquès, J.L. Domingo, Contamination of inert surfaces by SARS-CoV-2: Persistence, stability and infectivity. A review, Environ. Res. 193 (2021).
A.W. Chambers, K.W. Lacy, M.H.L. Liow, J.P.M. Manalo, A.A. Freiberg, Y.M. Kwon, Multiple Hip Intra-Articular Steroid Injections Increase Risk of Periprosthetic Joint Infection Compared With Single Injections, J. Arthroplasty. 32 (2017) 1980-1983.
L.F. Low, H. Audimulam, H.W. Lim, K. Selvaraju, S. Balasundram, Steroids in Maxillofacial Space Infection: A Retrospective Cohort Study, Open J. Stomatol. 07 (2017) 397-407.
A.M. Bandeira, E.F. Martinez, A.P.D. Demasi, Evaluation of toxicity and response to oxidative stress generated by orthodontic bands in human gingival fibroblasts, Angle Orthod. 90 (2020) 285-290.
J. You, S. Kim, J. Oh, H. Choi, M. Jih, Removal of a fractured needle during inferior alveolar nerve block: two case reports, J. Dent. Anesth. Pain Med. 17 (2017) 225-229.
S. Seon, B. Lee, B. Choi, J. Ohe, J. Lee, J. Jung, B. Hwang, M. Kim, Y. Kwon, Removal of a suture needle: a case report, Maxillofac. Plast. Reconstr. Surg. 43 (2021) 1-6.
S. Acham, A. Truschnegg, P. Rugani, B. Kirnbauer, K.E. Reinbacher, W. Zemann, L. Kqiku, N. Jakse, Needle fracture as a complication of dental local anesthesia: recommendations for prevention and a comprehensive treatment algorithm based on literature from the past four decades, Clin. Oral Investig. 23 (2019) 1109-1119.
Y. Zhu, Introduction to Heterostructured Materials: A Fast Emerging Field, Metall. Mater. Trans. A. 52A (2021) 4715-4726.
L. Romero-Resendiz, M. El-Tahawy, T. Zhang, M.C. Rossi, D.M. Marulanda-Cardona, T.Yang, V. Amigo-Borras, Y. Huang, H. Mirzadeh, I.J. Beyerlein, J.C. Huang, T.G. Langdon, Y.T. Zhu, Heterostructured stainless steel: Properties, current trends, and future perspectives, Mater. Sci. Eng. R. 150 (2022) 100691 Contents.
Y.T. Zhu, T.G. Langdon, The fundamentals of nanostructured materials processed by severe plastic deformation, Jom. 56 (2004) 58-63.
X. Wu, Y. Zhu, Heterogeneous materials: a new class of materials with unprecedented mechanical properties, Mater. Res. Lett. 5 (2017) 527-532.
Y. Zhu, K. Ameyama, P.M. Anderson, I.J. Beyerlein, H. Gao, H.S. Kim, E. Lavernia, S. Mathaudhu, H. Mughrabi, R.O. Ritchie, N. Tsuji, X. Zhang, X. Wu, Heterostructured materials: superior properties from hetero-zone interaction, Mater. Res. Lett. 9 (2021) 1-31.
Y. Zhu, X. Wu, Perspective on hetero-deformation induced (HDI) hardening and back stress, Mater. Res. Lett. 7 (2019) 393-398.
X. Wu, Y. Zhu, Heterostructured Materials: Novel Materials with Unprecedented Mechanical Properties, 1st ed., Jenny Stanford, 2021.
B. Khodashenas, The Influential Factors on Antibacterial Behaviour of Copper and Silver Nanoparticles, Indian Chem. Eng. 58 (2016) 224-239.
L.T. Liu, A.W.H. Chin, P. Yu, L.L.M. Poon, M.X. Huang, Antipathogen stainless steel combating COVID-19, Chem. Eng. J. 433 (2022) 133783.
Y. Sun, J. Zhao, L. Liu, T. Xi, C. Yang, Q. Li, K. Yang, Passivation potential regulating corrosion resistance and antibacterial property of 316L-Cu stainless steel in different simulated body fluids, Mater. Technol. 36 (2021) 118-130.
Y. Dong, J. Li, D. Xu, G. Song, D. Liu, H. Wang, M. Saleem Khan, K. Yang, F. Wang, Investigation of microbial corrosion inhibition of Cu-bearing 316L stainless steel in the presence of acid producing bacterium Acidithiobacillus caldus SM-1, J. Mater. Sci. Technol. 64 (2021) 176-186.
H. Dong, Z.C. Li, M.C. Somani, R.D.K. Misra, The significance of phase reversion-induced nanograined/ultrafine-grained (NG/UFG) structure on the strain hardening behavior and deformation mechanism in copper-bearing antimicrobial austenitic stainless steel, J. Mech. Behav. Biomed. Mater. 119 (2021) 104489 Contents.
C. Lei, X. Li, X. Deng, Z. Wang, G. Wang, Deformation mechanism and ductile fracture behavior in high strength high ductility nano/ultrafine grained Fe—17Cr—6Ni austenitic steel, Mater. Sci. Eng. A. 709 (2018) 72-81.
A. Kisko, A.S. Hamada, J. Talonen, D. Porter, L.P. Karjalainen, Effects of reversion and recrystallization on microstructure and mechanical properties of Nb-alloyed low-Ni high-Mn austenitic stainless steels, Mater. Sci. Eng. A. 657 (2016) 359-370.
M.C. Somani, M. Jaskari, S. Sadeghpour, C. Hu, R.D.K. Misra, T.T. Nyo, C. Yang, L.P. Karjalainen, Improving the yield strength of an antibacterial 304Cu austenitic stainless steel by the reversion treatment, Mater. Sci. Eng. A. 793 (2020) 139885.
A. Dumay, J.P. Chateau, S. Allain, S. Migot, O. Bouaziz, Influence of addition elements on the stacking-fault energy and mechanical properties of an austenitic Fe—Mn—C steel Mater. Sci. Eng. A. 483-484 (2008) 184-187.
B.D. Cullity, Elements of X-Ray Diffraction, Addison-Wesley Metallurgy series, Massachusetts, 1956.
M.J. Sohrabi, M. Naghizadeh, H. Mirzadeh, Deformation-induced martensite in austenitic stainless steels: A review, Arch. Civ. Mech. Eng. 20 (2020) 1-24.

(56) References Cited

OTHER PUBLICATIONS

M.J. Sohrabi, H. Mirzadeh, C. Dehghanian, Thermodynamics basis of saturation of martensite content during reversion annealing of cold rolled metastable austenitic steel, Vacuum. 174 (2020) 109220.
P.M. Ahmedabadi, V. Kain, A. Agrawal, Modelling kinetics of strain-induced martensite transformation during plastic deformation of austenitic stainless steel, Mater. Des. 109 (2016) 466-475.
H.C. Shin, T.K. Ha, Y.W. Chang, Kinetics of deformation induced martensitic transformation in a 304 stainless steel, Scr. Mater. 45 (2001) 823-829.
B. Ravi Kumar, B. Mahato, N.R. Bandyopadhyay, D.K. Bhattacharya, Comparison of rolling texture in low and medium stacking fault energy austenitic stainless steels, Mater. Sci. Eng. A. 394 (2005) 296-301.
C. Donadille, R. Valle, P. Dervin, R. Penelle, Development of texture and microstructure during cold-rolling and annealing of FCC alloys: example of an austenitic stainless steel, Acta Metall. 37 (1989) 1547-1571.
J. Lu, L. Hultman, E. Holmström, K.H. Antonsson, M. Grehk, W. Li, L. Vitos, A. Golpayegani, Stacking fault energies in austenitic stainless steels, ACTA Mater. 111 (2016) 39-46.
M. Perez, F. Perrard, V. Massardier, A. Deschamps, Low Temperature Solubility of Copper in Iron : Experimental Study Using Thermoelectric Power , Small Angle X-ray Scattering and Tomographic Atom Probe, Philos. Mag. 85 (2005) 2197-2210.
The Materials Information Society, ASM Handbook—Alloy Phase Diagrams, 1992.
T. Xi, M. Babar Shahzad, D. Xu, J. Zhao, C. Yang, M. Qi, K. Yang, Copper precipitation behavior and mechanical properties of Cu-bearing 316L austenitic stainless steel: A comprehensive cross-correlation study, Mater. Sci. Eng. A. 675 (2016) 243-252.
L.T. Liu, Y.Z. Li, K.P. Yu, M.Y. Zhu, H. Jiang, P. Yu, M.X. Huang, A novel stainless steel with intensive silver nanoparticles showing superior antibacterial property, Mater. Res. Lett. 9 (2021) 270-277.
R.P. George, P. Muraleedharan, K.R. Sreekumari, H.S. Khatak, Influence of surface characteristics and microstructure on adhesion of bacterial cells onto a type 304 stainless steel, Biofouling. 19 (2003) 1-8.
T. Juhna, D. Birzniece, J. Rubulis, Effect of phosphorus on survival of *Escherichia coli* in drinking water biofilms, Appl. Environ. Microbiol. 73 (2007) 3755-3758.
C.H. Liao, L.M. Shollenberger, Survivability and long-term preservation of bacteria in water and in phosphate-buffered saline, Lett. Appl. Microbiol. 37 (2003) 45-50.
V. Kain, Stress corrosion cracking (SCC) in stainless steels, Woodhead Publishing Limited, 2011.

* cited by examiner

HETEROSTRUCTURED ANTIMICROBIAL STAINLESS STEEL AND METHOD FOR SYNTHESIZING THE SAME

FIELD OF THE INVENTION

The present invention generally relates to an antimicrobial stainless steel. More specifically, the present invention relates to heterostructured antimicrobial stainless steel and methods for synthesizing the same.

BACKGROUND OF THE INVENTION

Due to outbreak of pandemic diseases, such as SARS-CoV-2 and covid-19, decreasing the risk of contagion by contact with contaminated surfaces becomes a world priority. The design and development of antimicrobial materials help to overcome the potential danger of transmission of multiple microorganisms. However, multi-functional purposes require multi-disciplinary properties. The antimicrobial materials should also combine high mechanical performance to reduce the economic and security impact of devices replacement after mechanical failure.

Stainless steel (SS) is an accessible and cost-effective material that can be combined with antimicrobial qualities for biosecurity in medical, industrial, and public spaces. In particular, 316L SS is extensively used in medical devices, food refrigeration components, jewelry, pharmaceutical equipment, potable water containers, wastewater treatment, marine and architectural applications, among others. Advance mechanical performance is required in some medical and daily applications such as hand-holders and door handles that need to resist continuous friction; orthodontic archwires, molar bands and brackets that need to resist compression loads in the oral environment; and orthodontic drills that require a high fatigue resistance; among others.

However, the current properties of the 316L SS are in many cases not enough to sustain the mechanical stress of multiple applications. Examples of these deficiencies include failure of medic or orthodontic devices and breakage of hypodermic needles during clinic procedures, requiring complex and risky extraction procedures.

Heterostructured materials (HSMs) allow obtaining advanced mechanical properties led by hetero-deformation induced (HDI) strengthening. Contrastingly from other approaches, such as severe plastic deformation (SPD) techniques, HSMs can be obtained under the principles of large-scalability and low-cost. The HSMs create a synergy between the mechanical response of mutually constraining soft and hard zones under dominantly planar slip. As the soft zones start deforming before the hard ones, strain gradients will be generated near the soft/hard zone boundaries. To compensate the strain gradient, geometrically necessary dislocation (GND) pile-ups will be formed in the soft zone near the interface and applied a stress against the hard zone. Long-range back and forward stress, also known HDI stress, will be formed in the soft and hard zones, respectively. The back stress strengthens the soft zones, while the forward stress makes the hard zone easier to deform. As result, the HSMs join the virtues of multiple strengthening mechanisms such as grain boundaries density increment, solid solution, twinning, dispersion of second phases, accumulation of dislocations, etc., with a major contribution from HDI strengthening. As result, HSMs shown a reduced trade-off between strength and ductility.

From the above, the HSMs and SS are strong candidates to combine with antimicrobial properties to assist on the decrement of contagion-risk of multiple diseases. Many metallic nanoparticles (NPs) with antimicrobic activity have been reported. Silver (Ag) and copper (Cu) NPs are the most reported against multiple microorganisms, including bacteria, viruses, fungi and algae. However, Cu is much more accessible and cost-effective than Ag. Moreover, recent findings show that antimicrobial performance of coarse Cu as more effective than Ag.

SUMMARY OF THE INVENTION

In accordance with a first aspect of the present disclosure, a heterostructured antimicrobial stainless steel with improved yield strength and reduced strength-to-ductility trade-off is provided. The heterostructured antimicrobial stainless steel has a heterostructured lamella structure arrangement formed with lamellar coarse grains and ultra-fine grains; and a plurality of mechanically strengthening defects including: interstitial solid solution alloying elements; substitutional solid solution alloying elements; twins; multiphasic interfaces formed with face-centered cubic austenite phase and body-centered cubic martensite phase; statistically stored dislocations; geometrically necessary dislocations pile-ups, and/or stacking faults.

In accordance with a second aspect of the present disclosure, a method for synthesizing the heterostructured antimicrobial stainless steel is provided. The method comprises: a) casting a starting alloy with addition of antimicrobial element; b) subjecting the starting alloy to solid solution treatment to form a solid solution; c) quenching the solid solution to form a solid-solution treated stainless steel; d) subjecting the solid-solution treated stainless steel to aging to form an aged stainless steel; e) subjecting the aged stainless steel to cold rolling to form a cold-rolled stainless steel; f) subjecting the cold-rolled stainless steel to a final heat treatment to form the heterostructured antimicrobial stainless steel.

In a further aspect, in step b), the solid solution treatment is performed at 1050° C. for a processing time in a range from 30 to 120 minutes.

In a further aspect, in step d), the aging is performed at an aging temperature in a range from 550° C. to 700° C. for an aging time in a range from 30 to 360 minutes.

In a further aspect, in step e), the thickness of the aged stainless steel is reduced in a range from 60% to 80% by cold rolling.

In a further aspect, in step f), the final heat treatment is performed with a heating rate of 40° C. $s^{-1}$.

In a further aspect, in step f), the final heat treatment is a posterior aging treatment.

In a further aspect, the posterior aging treatment is performed at an aging temperature in a range from 500 to 650° C. for an aging time in a range from 30 to 90 minutes.

In a further aspect, in step f), the final heat treatment is an annealing treatment.

In a further aspect, the annealing treatment is performed at an annealing temperature in a range from 700 to 800° C. for an annealing time in a range from 30 to 900 seconds.

In a further aspect, the starting alloy has a nominal chemical composition of Cu in 0.01-0.08%, Ni in 3.00-14.00%, Cr in 7.00-20.00%, Mo≤3.00%, Mn≤2.00%, Si≤1.00%, balanced Fe, and addition of antimicrobial element≤5.00%; and the antimicrobial element is Cu, Zn or Ag.

In accordance with a third aspect of the present disclosure, a method for synthesizing the heterostructured antimicrobial stainless steel is provided. The method comprises: a) casting a starting alloy with addition of antimicrobial element; b)

subjecting the starting alloy to solid solution treatment to form a solid solution; c) quenching the solid solution to form a solid-solution treated stainless steel; d) subjecting the stainless steel to cold rolling to form a cold-rolled stainless steel; e) subjecting the cold-rolled stainless steel to a final heat treatment to form the heterostructured antimicrobial stainless steel.

In a further aspect, in step b), the solid solution treatment is performed at 1050° C. for a processing time in a range from 30 to 120 minutes.

In a further aspect, in step d), a thickness of the aged stainless steel is reduced in a range from 60% to 80% by cold rolling.

In a further aspect, in step e), the final heat treatment is performed with a heating rate of 40° C. $s^{-1}$.

In a further aspect, in step e), the final heat treatment is a posterior aging treatment.

In a further aspect, the posterior aging treatment is performed at an aging temperature in a range from 500 to 650° C. for an aging time in a range from 30 to 90 minutes In a further aspect, in step e), the final heat treatment is an annealing treatment.

In a further aspect, the annealing treatment is performed at an annealing temperature in a range from 700 to 800° C. for an annealing time in a range from 30 to 900 seconds.

In a further aspect, the starting alloy has a nominal chemical composition of Cu in 0.01-0.08%, Ni in 3.00-14.00%, Cr in 7.00-20.00%, Mo≤3.00%, Mn≤2.00%, Si≤1.00%, balanced Fe, and addition of antimicrobial element≤5.00%; and the antimicrobial element is Cu, Zn or Ag.

By combining all the recognized-so-far strengthening mechanisms, i.e., solid solution (substitutional and interstitial), high density of grain boundaries, second phase dispersion, dislocation accumulation, twinning, strain-induced transformation, and HDI, the heterostructured antimicrobial stainless steel provided by the present invention is able to serve as a basis for designing cost-effective, advanced-mechanical-resistant, and multifunctional HSMs for the food-processing, biosafety, structural and biomedical fields.

BRIEF DESCRIPTION OF THE DRAWINGS

Aspects of the present disclosure may be readily understood from the following detailed description with reference to the accompanying figures. The illustrations may not necessarily be drawn to scale. That is, the dimensions of the various features may be arbitrarily increased or reduced for clarity of discussion. There may be distinctions between the artistic renditions in the present disclosure and the actual apparatus due to manufacturing processes and tolerances. Common reference numerals may be used throughout the drawings and the detailed description to indicate the same or similar components.

DETAILED DESCRIPTION

Figure 1:
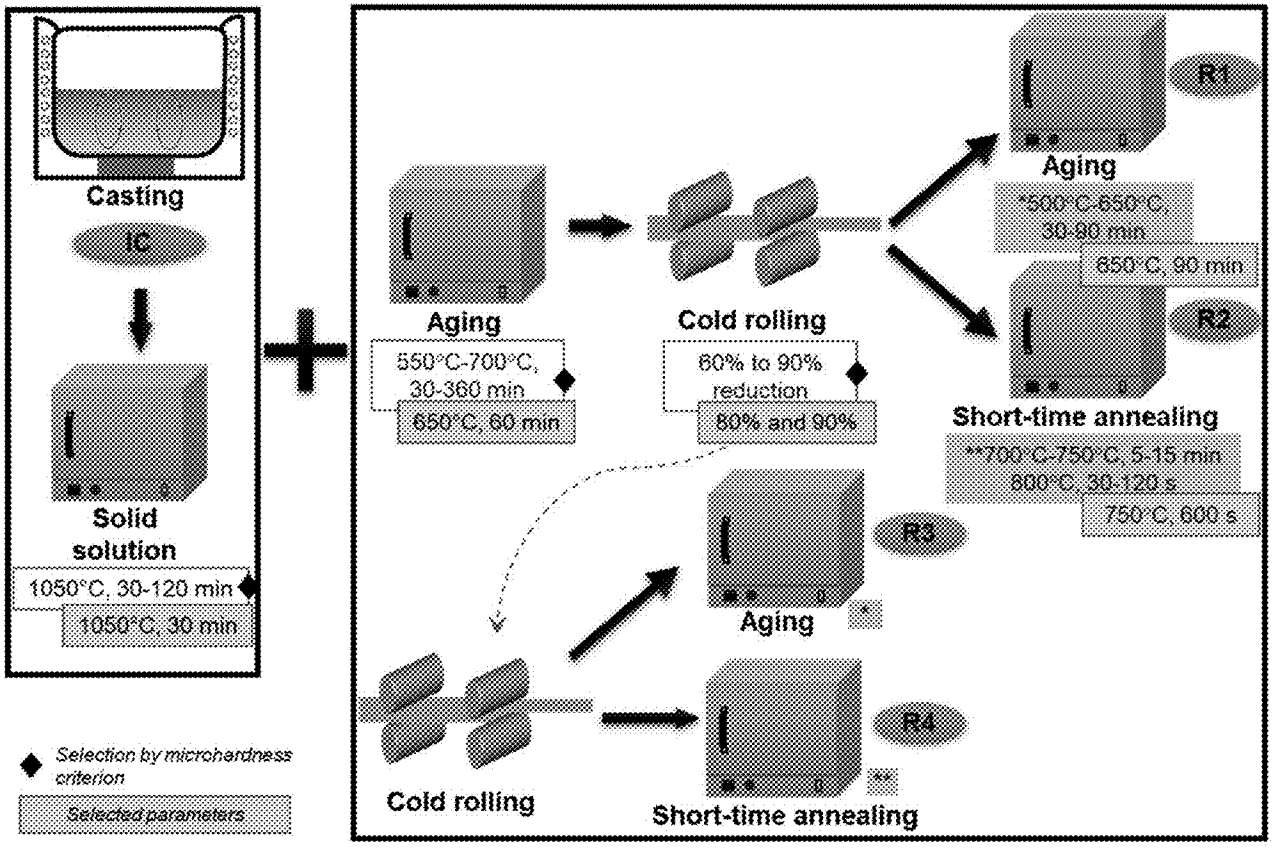
FIG. 1 shows selection of starting parameters and four thermo-mechanical routes used to elaborate heterostructured antimicrobial stainless steel (H&ASS) according to various embodiment of the present invention.

In the following description, preferred examples of the present disclosure will be set forth as embodiments which are to be regarded as illustrative rather than restrictive. Specific details may be omitted so as not to obscure the present disclosure; however, the disclosure is written to enable one skilled in the art to practice the teachings herein without undue experimentation.

Throughout this specification, unless the context requires otherwise, the word "comprise" or variations such as "comprises" or "comprising", will be understood to imply the inclusion of a stated integer or group of integers but not the exclusion of any other integer or group of integers. It is also noted that in this disclosure and particularly in the claims and/or paragraphs, terms such as "comprises", "comprised", "comprising" and the like can have the meaning attributed to it such that they allow for elements not explicitly recited, but exclude elements that are found in the prior art or that affect a basic or novel characteristic of the present invention. Furthermore, throughout the specification and claims, unless the context requires otherwise, the word "include" or variations such as "includes" or "including", will be understood to imply the inclusion of a stated integer or group of integers but not the exclusion of any other integer or group of integers.

References in the specification to "one embodiment", "an embodiment", "an example embodiment", etc., indicate that the embodiment described can include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

In order to address the issues and needs discussed above, the present invention provides a heterostructured antimicrobial stainless steel (H&ASS) with improved yield strength and reduced strength-to-ductility trade-off and methods for synthesizing the same.

Synthesis of the H&ASS

The raw materials for synthesizing the H&ASS include a starting stainless steel alloy with addition of antimicrobial element such as Ag, Cu or Zn. the starting alloy has a nominal chemical composition of Cu in 0.01-0.08%, Ni in 3.00-14.00%, Cr in 7.00-20.00%, Mo≤3.00%, Mn≤2.00%, Si≤1.00%, balanced Fe, and addition of antimicrobial element≤5.00%. For example, the starting alloy may be a cast 316L SS having a chemical composition as shown in Table 1 with 3 wt. % Cu additions (316LCu). The starting alloy may be prepared by any casting techniques. The as-cast materials are indicated as initial condition (IC) hereinafter. The no more than 5 wt. % of antimicrobial element addition was selected to combine antimicrobial properties without a large increasing on stacking fault energy (SFE) that might affect the planar slip. It should be appreciated that the raw materials for synthesizing the H&ASS may include any other suitable types of alloys. In some embodiments, the cast 316L SS can be replaced with any suitable types of stainless steel. In some embodiments, the Cu additions may be replaced with Ag or Zn additions.

For comparison and reference, a cast 316LSS without addition of antimicrobial element (316L) was used as a reference starting alloy for synthesizing a non-antimicrobial heterostructured stainless steel.

TABLE 1

Chemical composition of the starting alloys 316L SS and 316LCu SS

| Alloy | C | Cr | Mn | Ni | P | Si | S | Mo | Cu | Fe |
|---|---|---|---|---|---|---|---|---|---|---|
| 316L | 0.02 | 17.03 | 1.92 | 12.04 | 0.02 | 0.72 | 0.01 | 2.56 | — | Balance |
| 316LCu | 0.02 | 17.38 | 1.91 | 12.15 | 0.02 | 0.75 | 0.01 | 2.58 | 3.01 | Balance |

Both alloys were cut to obtain 10-mm thick plates. The plates were subjected to a solid solution heat treatment under Argon (Ar) atmosphere at 1050° C. for 30 min and posterior water quenching.

FIG. 1 shows selection of starting parameters and four thermo-mechanical routes used to elaborate the H&ASS. As shown, four routes (R1, R2, R3, and R4) were designed for a synergy between multiple strengthening mechanisms (grain boundaries density, solid solution, strain-induced phase transformation, twinning, dispersion of second phases, accumulation of dislocations, and HDI) with different grain and Cu particles size distributions.

In FIG. 1, the tested and selected (or optimal) processing parameters for the pre-prepared microstructural conditions are shown in white and grey boxes respectively. Microhardness and time production criteria were used to select the processing parameters for the processing steps of solid solution (SSol), aging (A), and cold rolling (CR).

Figure 2A:
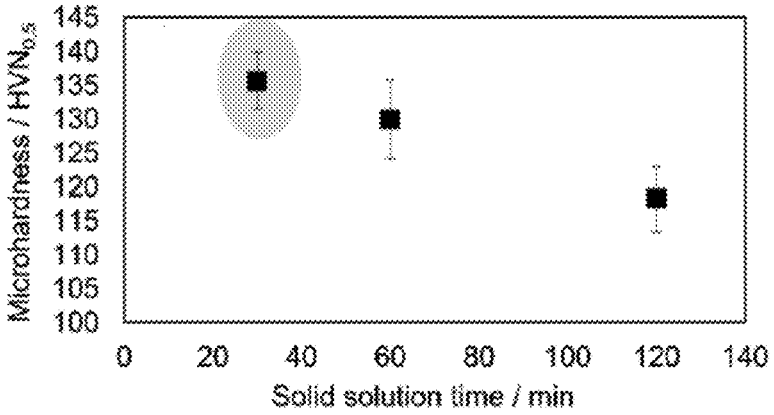
FIG. 2A shows the microhardness of samples against solid solution processing time.
Figure 2B:
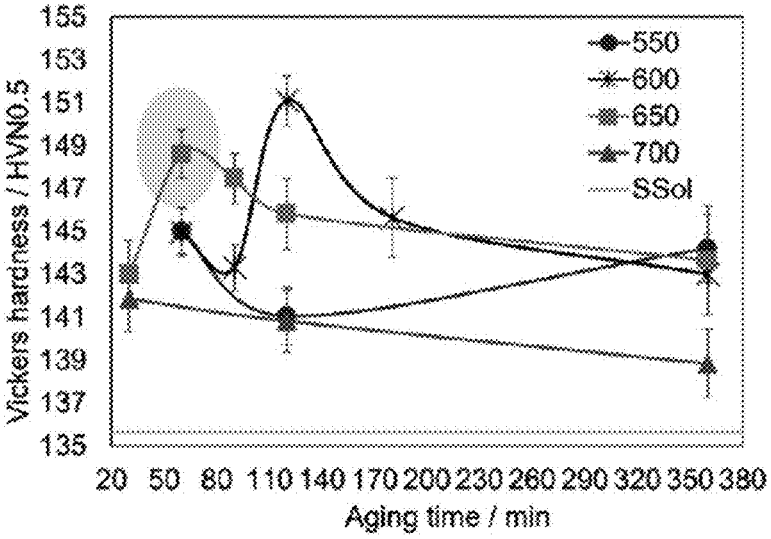
FIG. 2B shows the Vickers hardness of samples against aging time at different aging temperatures.
Figure 2C:
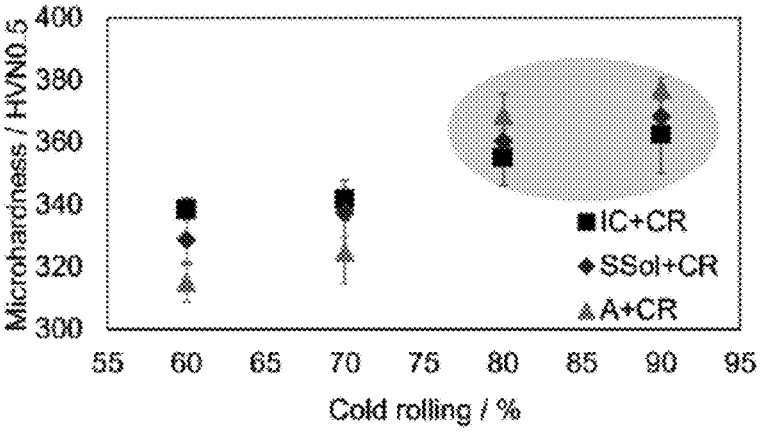
FIG. 2C shows microhardness of samples against cold rolling thickness reduction.
Figure 3A:
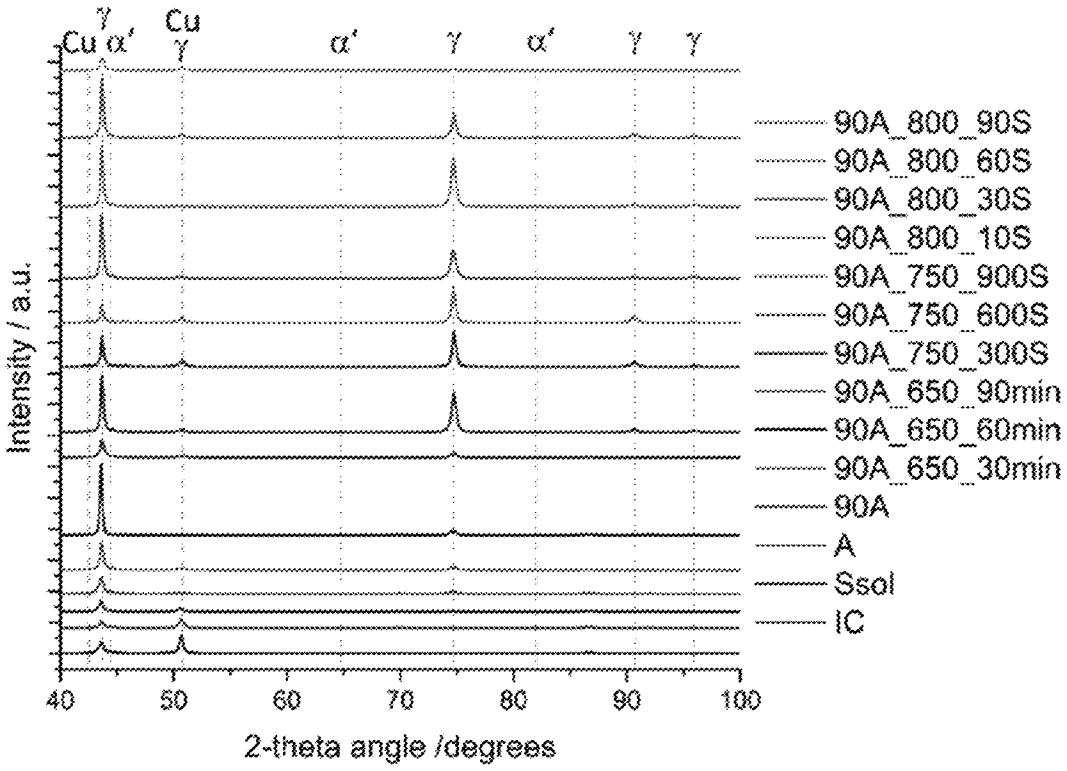
FIGS. 3A to 3D shows diffractograms of the homogeneous initial condition, solid solution, aged compared to the H&ASS elaborated through the four thermo-mechanical routes according to various embodiments of the present invention.
Figure 3B:
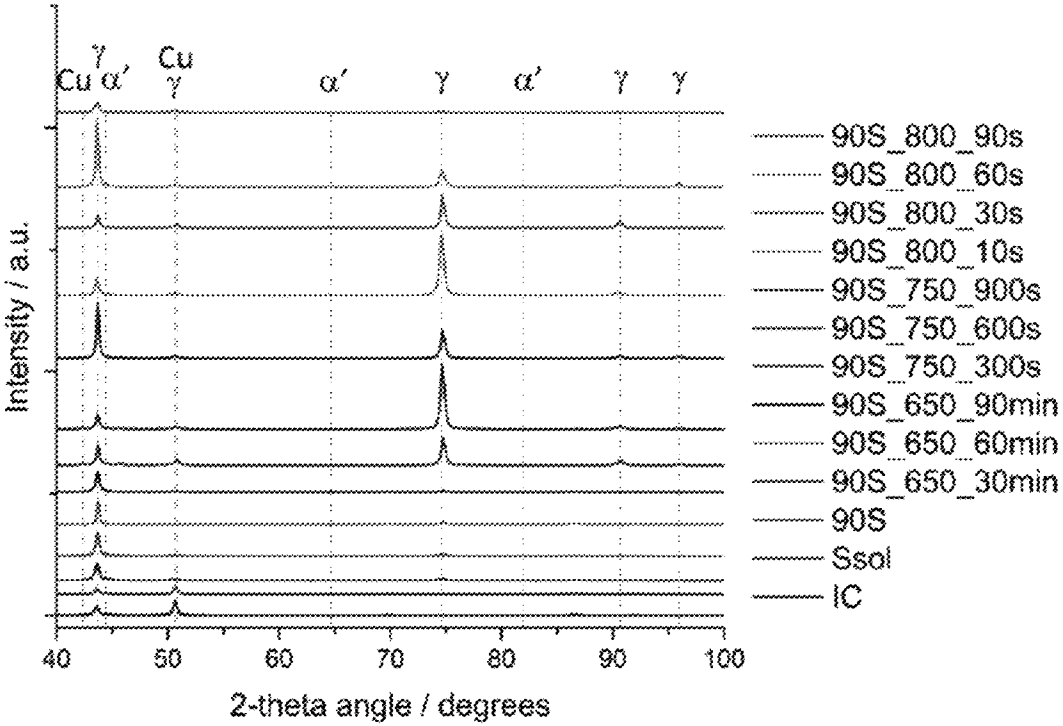
Figure 3C:
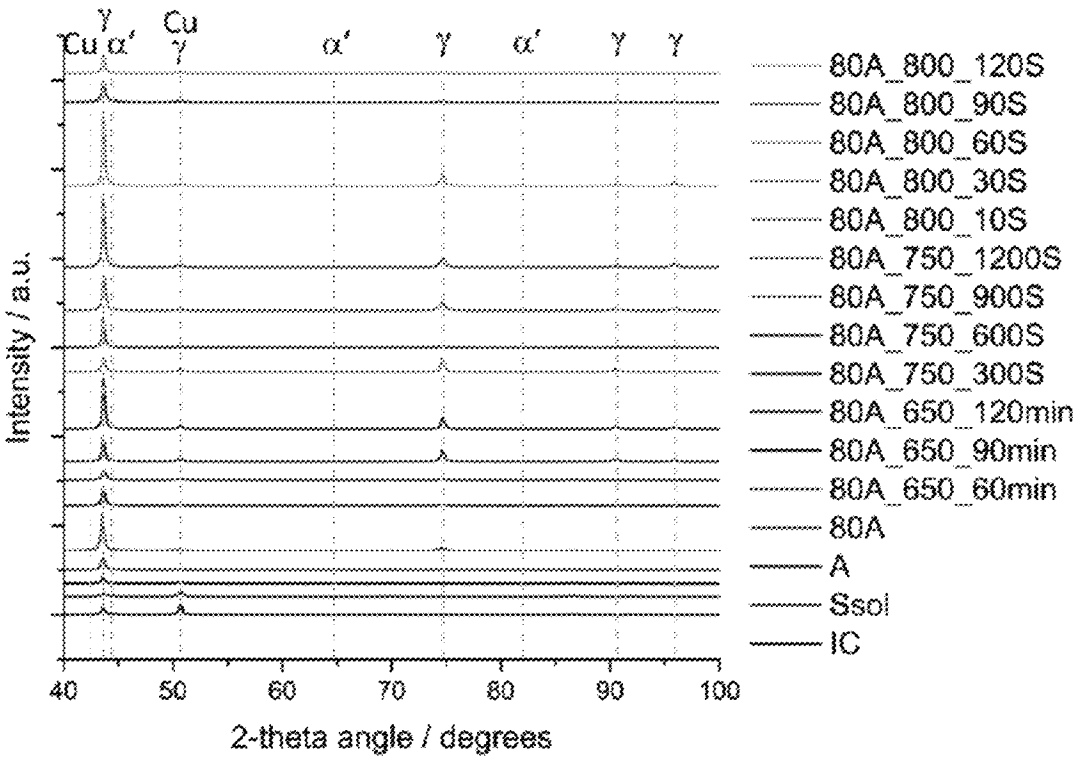
Figure 3D:
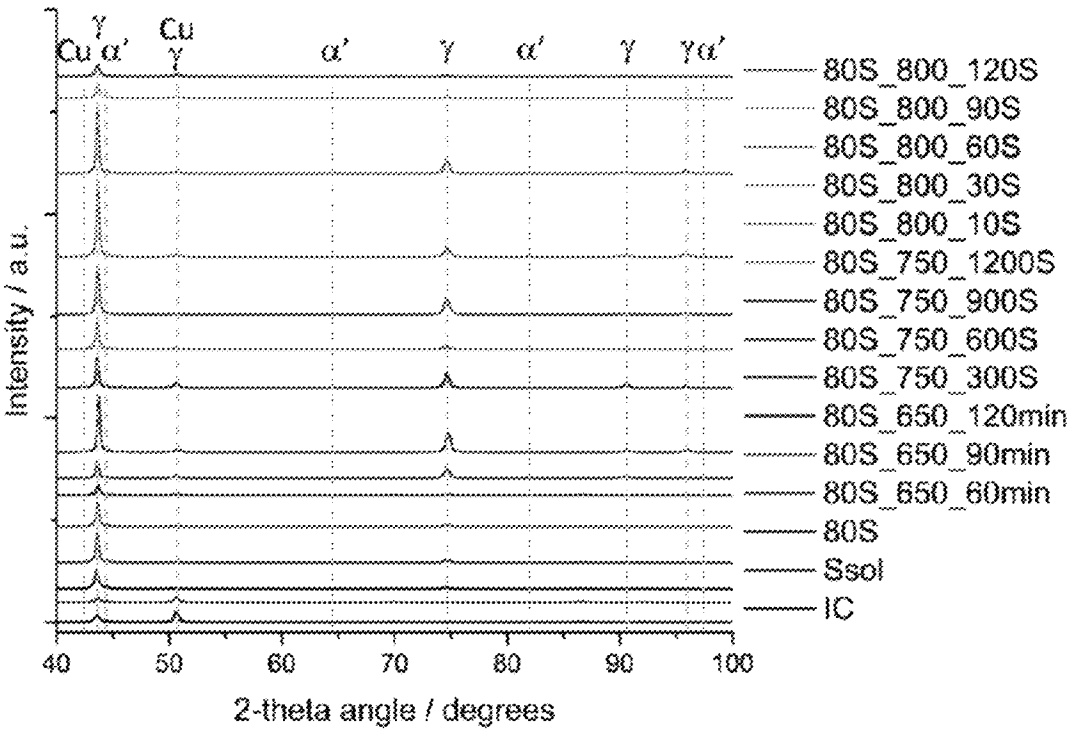

FIG. 2A shows the microhardness of samples against solid solution processing time. FIG. 2B shows the Vickers hardness of samples against aging time at different aging temperatures. FIG. 2C shows microhardness of samples against cold rolling thickness reduction (in percentage %). The temperature and time ranges were selected for optimizing mechanical behavior of H&ASS samples. All the heat treatments were applied under Ar atmosphere with posterior water quenching. The CR was applied at room temperature with an average of 0.15 mm thickness reduction per pass.

The routes R1 and R2 consisted of subjecting the SSol treated samples to a first aging to precipitate out the Cu particles. Posterior cold rolling was applied to refine the grain size and strain-induced phase martensite transformation occurrence. Then, a second aging (in route R1) or short time annealing (in route R2) were applied for partial recrystallization, partial phase transformation reversion, and encouraging more Cu precipitation in the matrix.

As indicated in FIG. 1, the second aging was applied at a temperature in a range from 500° C. to 650° C. for an aging time in a range from 30 to 60 min. The short time annealing was applied at an annealing temperature from 700° ° C. to 750° ° C. for an annealing time from 5 to 15 min, or at an annealing temperature 800° C. for an annealing time from 30 to 120 s. All the heat treatments were performed under a heating rate of about 40° C. $s^{-1}$.

For the routes R3 to R4, the SSol treated samples were subjected to cold rolling under the same conditions described above. Posteriorly, aging (in route R3) or short time annealing (in route R4) were applied. The heat treatments were applied under the abovementioned conditions.

The Table 2 lists the processing conditions and identification of the elaborated H&ASSs. Hereinafter, the characterized samples will be referred by a three-sections identification: i) cold rolling reduction (80 or 90) with a letter indication previous aging (A) or only solid solution (S), ii) heat treatment temperature after rolling, and iii) heat treatment time holding. For example: 90A_650_60 min corresponds to a H&ASS sample processed by solid solution treatment, aging, 90% thickness reduction, and posterior aging at 650° ° C. for 60 min (in route R1); 90A_750_600 s corresponds to a H&ASS sample processed by solid solution treatment, aging, 90% thickness reduction, and annealing at 750° C. for 600 s (in route R2); 90S_650_60 min corresponds to a H&ASS sample processed, solid solution treatment, 90% thickness reduction, and posterior aging at 650° C. for 60 min (in route R3); and 90S_750_600 s corresponds to a H&ASS sample processed by solid solution treatment, 90% thickness reduction, and annealing at 750° ° C. for 600 s (in route R4).

TABLE 2

Processing conditions and identification of the elaborated H&ASSs

| Aging | | Cold rolling | Aging | | Short time annealing | | Sample | |
|---|---|---|---|---|---|---|---|---|
| s | ° C. | % | s | ° C. | s | ° C. | identification | Route |
| 3600 | 650 | 90 | 1800 | 650 | — | — | 90A_650_30 min | 1 |
| 3600 | 650 | | 3600 | 650 | — | — | 90A_650_60 min | |
| 3600 | 650 | | 4800 | 650 | — | — | 90A_650_80 min | |
| 3600 | 650 | | — | — | 300 | 750 | 90A_750_300 s | 2 |
| 3600 | 650 | | — | — | 600 | 750 | 90A_750_600 s | |
| 3600 | 650 | | — | — | 900 | 750 | 90A_750_900 s | |
| 3600 | 650 | | — | — | 30 | 800 | 90A_800_30 s | |
| 3600 | 650 | | — | — | 60 | 800 | 90A_800_60 s | |
| 3600 | 650 | | — | — | 90 | 800 | 90A_800_90 s | |
| — | — | | 1800 | 650 | — | — | 90S_650_30 min | 3 |
| — | — | | 3600 | 650 | — | — | 90S_650_60 min | |
| — | — | | 4800 | 650 | — | — | 90S_650_80 min | |
| — | — | | — | — | 300 | 750 | 90S_750_300 s | 4 |
| — | — | | — | — | 600 | 750 | 90S_750_600 s | |
| — | — | | — | — | 900 | 750 | 90S_750_900 s | |
| — | — | | — | — | 30 | 800 | 90S_800_30 s | |
| — | — | | — | — | 60 | 800 | 90S_800_60 s | |
| — | — | | — | — | 90 | 800 | 90S_800_90 s | |
| 3600 | 650 | 80 | 3600 | 650 | — | — | 80A_650_60 min | 1 |
| 3600 | 650 | | 5400 | 650 | — | — | 80A_650_90 min | |
| 3600 | 650 | | 7200 | 650 | — | — | 80A_650_120 min | |
| 3600 | 650 | | — | — | 600 | 750 | 80A_750_600 s | |
| 3600 | 650 | | — | — | 900 | 750 | 80A_750_900 s | |
| 3600 | 650 | | — | — | 1200 | 750 | 80A_750_1200 s | |
| 3600 | 650 | | — | — | 10 | 800 | 80A_800_10 s | |
| 3600 | 650 | | — | — | 30 | 800 | 80A_800_30 s | |
| 3600 | 650 | | — | — | 60 | 800 | 80A_800_60 s | |
| 3600 | 650 | | — | — | 90 | 800 | 80A_800_90 s | |
| 3600 | 650 | | — | — | 120 | 800 | 80A_800_120 s | |
| — | — | | 3600 | 650 | — | — | 80S_650_60 min | 3 |
| — | — | | 5400 | 650 | — | — | 80S_650_90 min | |
| — | — | | 7200 | 650 | — | — | 80S_650_120 min | |
| — | — | | — | — | 600 | 750 | 80S_750_600 s | 4 |
| — | — | | — | — | 900 | 750 | 80S_750_900 s | |
| — | — | | — | — | 1200 | 750 | 80S_750_1200 s | |
| — | — | | — | — | 10 | 800 | 80S_800_10 s | |
| — | — | | — | — | 30 | 800 | 80S_800_30 s | |
| — | — | | — | — | 60 | 800 | 80S_800_60 s | |
| — | — | | — | — | 90 | 800 | 80S_800_90 s | |
| — | — | | — | — | 120 | 800 | 80S_800_120 s | |

Microstructural Characterization of the H&ASS

The H&ASSs were cut by waterjet cutting machine and subjected to metallographic preparation up to mirror-like surface condition with colloidal silica of 0.1 μm particle size. XRD measurements were carried out in a D2 phaser Bruker diffractometer with LYNXEYE XE-T detector, Cu-Kα radiation, 30 KV voltage, 10 mA current, and step size of 0.01°. For EBSD, the samples were electropolished in 25 vol. % HNO3 solution at ~−196° C. for 60 s with 20V voltage. EBSD analyses were carried out with step size of 0.35 μm for volumetric and 50 nm for local analyses.

For comparison purposes, the phases content was estimated by two methods derived from XRD and EBSD measurements. From XRD, the direct comparison method of the integrated intensity of different peaks was used. The (220), (311), and (222) peaks of the austenite phase (γ) and (200), (211), and (220) of the martensite phase (α') were used for the phase estimation. From EBSD, a semi-empirical relationship between the γ(220), γ(311), and α'(211) peaks was used.

For transmission electron microscopy (TEM), the samples were grinded up to a 50 μm thickness and punched into 3 mm diameter discs. Electron-transparent regions were obtained in a precision ion polishing system (PIPS) Gatan 695. The observation was done in a JEOL 2100 F TEM equipped with energy dispersive X-ray spectroscopy (EDX) at 200 keV acceleration voltage.

Vickers hardness was measured by a BuehlerVH1202 Vickers/Knoop hardness tester with a load of 500 g and a holding time of 10 s. Hardness values were obtained by averaging at least ten indents for each sample. The H&ASSs were cut along the rolling direction into dog-bone-shaped specimens, with gauge length of 12.5 mm and width to thickness relationship of ~2.0 after polishing. Uniaxial tensile tests were performed on a universal testing machine Instron 3382 with a strain rate of $10^{-4}$ $s^{-1}$ at room temperature. Tensile tests were performed three times per processing condition.

Antibacterial Assessment of the H&ASS

The plate counting method was used to evaluate the antibacterial effect. *E. coli* ATCC 25922 was inoculated in sterilized tryptone soya broth (TSB) agar plate and incubated at 37° C. for 24 hours. Subsequently, single colonies were diluted to OD600 nm 0.05 (~107 CFU $ml^{+1}$) with sterilized phosphate buffered saline (PBS) buffer (pH≅7.2, Sigma-Aldrich) using a UV-Vis spectrophotometer. The final concentration was ~106 CFU $ml^{-1}$ with a 10-fold dilution. The materials with a surface area of 1 $cm^2$ grinded with SiC up to 2000 grade were autoclaved before the test. Posteriorly, the materials were introduced into a 24-well plate and inoculated with 50 μl bacterial suspension solution on their surface and incubated at 37° C. Next, the metal sheets were picked up at different time points (0.5 h, 1 h, 2 h, 6 h, and 24 h), washed with 2450 μl PBS buffer, and resuspended with a vortex mixer (MX-S, Dragon Laboratory Instruments Ltd.) for 60 s. Finally, 100 μl of the resuspended bacterial solution was spread on the TSB agar plate and incubated for 24 h. The survival rate was calculated by:

$$C\ \% = \left[1 - (C_{ini} - C_t)/C_{ini}\right] \times 100\% \quad (1)$$

where C represents the bacterial survival rate, $C_{ini}$ is the average bacterial concentration at the material surface at 0 h (in CFU $ml^{+1}$), and (', represents the average bacterial concentration at the different testing times (in CFU $ml^{+1}$). Three replicates per processing condition were tested for statistical purposes.

Microstructural Assessment Results

FIGS. 3A to 3D shows diffractograms of the homogeneous initial condition (IC), solid solution (SSol), aged (A) compared to the H&ASS elaborated through all of the routes. Microstructural evolution in 90A, 90S, 80A, and 80S series was qualitatively similar. All the samples are composed by face-center cubic (FCC)-γ and body-center cubic (BCC)-α' phases. Although, 80% CR generated ~0.6 vol. % more α' phase than 90% CR. The slightly higher α' formation after 80% CR could compensate the lower grain boundary density expected from lower straining. Thus, 80% and 90% CR samples have similar hardness values. Low-intense peaks of copper out of the solid solution were also observed, especially in the aged sample.

Figure 4A:
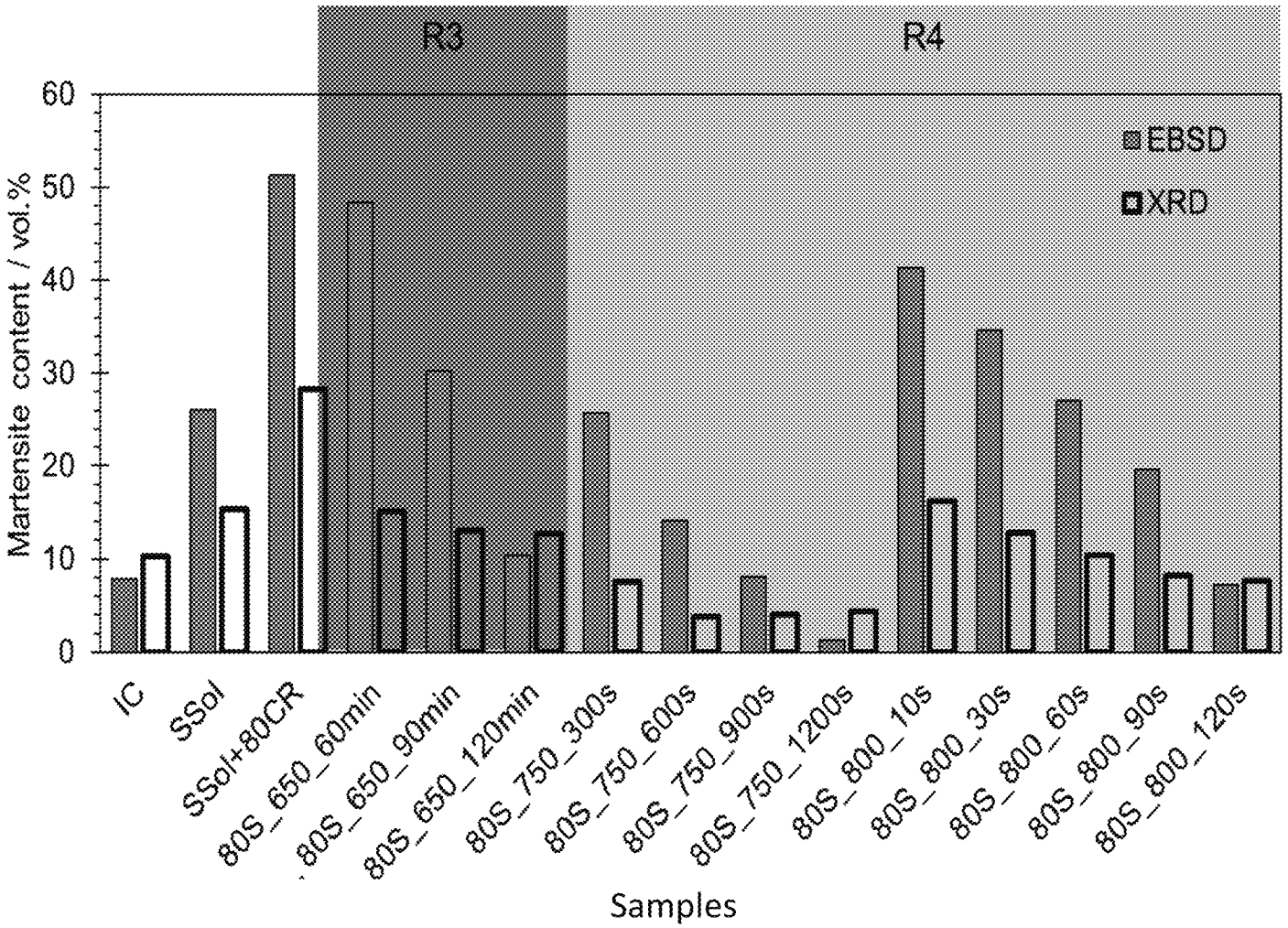
FIG. 4A shows the estimation of martensite content by electron backscattering diffraction (EBSD) and X-ray diffraction (XRD) measurements for the 80S series produced by routes R3 and R4.
Figures 4B, 4C, 4D:
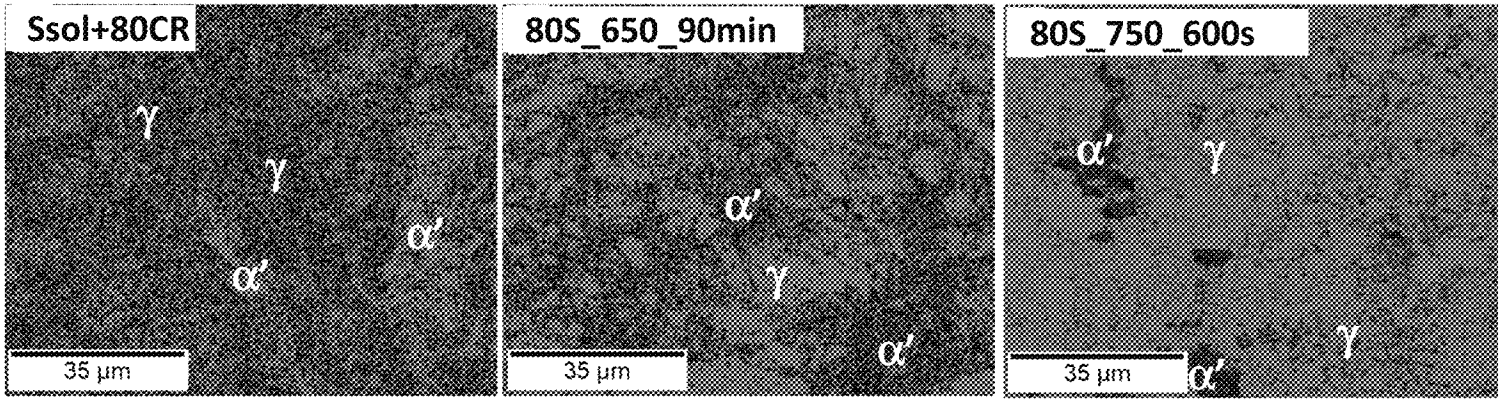
FIG. 4B shows EBSD phase contrast of SSol+80CR sample.
FIG. 4C shows EBSD phase contrast of a 80S_650_90 min sample.
FIG. 4D shows a EBSD phase contrast of a 80S_750_600 s sample.

FIG. 4A shows the estimation of martensite content by EBSD and XRD measurements for the 80S series produced by R3 and R4, and its comparison with reference homogeneous as-received (IC), Solid solution (SSol), and SSol+80CR conditions. FIG. 4B shows EBSD phase contrast of SSol+80CR sample (that is, the sample processed by solid solution treatment and 80% cold rolling thickness reduction); FIG. 4C shows EBSD phase contrast of a 80S_650_90 min sample (that is, the sample processed by solid solution treatment, 80% cold rolling thickness reduction, and annealing at 650° C. for 90 min); FIG. 4D shows a EBSD phase contrast of a 80S_750_600 s sample (that is, the sample processed by solid solution treatment, 80% cold rolling thickness reduction, and annealing at 750° ° C. for 600 s).

Similar qualitative tendencies are expected for the other 80A, 90A, and 90S series. The calculation from EBSD tends to higher α' contents than the XRD based method. However, both of them have lacks of accuracy to consider. The EBSD method has low statistics and might overestimate the α' due to metallographic preparation strain. The XRD method do not consider the effect of crystallographic texture, which might be relevant after rolling or recrystallization processes that tend towards gross- and brass-like or cube-like textures in SS, respectively. Despite the quantitative disparities, both methods follow similar qualitative tendencies towards decreasing α' vol. % with temperature and time.

As seen in FIG. 4A, the lowest α' contents by EBSD and XRD is obtained with the samples processed by annealing at 750° C., indicating that 750° C. is the minimum required temperature for a complete reversion from strain induced martensite (SIM) to austenite for the H&ASS. The difference between theoretical value, which is about 625° ° C. for austenitic steels with varying Cr/Ni ratios, and the present results might be related to the effects of no unimodal grain size distribution, drag solutes (as Mo), crystallographic texture, and the effect of Cu addition.

From the XRD method of FIG. 4A, the IC sample is composed of 89.7 vol % of γ phase and 10.3 vol. % α' phase. In the SSol and SSol+80CR samples, the volume fraction of α' phase increased to 15.4% and 28.3%, respectively. The SIM fraction is lower than the theoretically expected values. Considering an equivalent deformation of about 1.8 after 80% CR, the expected vol. % of α' is of about 80%.

The suppression of α' formation might be related to the Ni and Cr equivalents (Nieq and Creq) as well as to the SFE value of the 316L and 316L Cu alloy. The Ni and Cr equivalents in wt. % may be calculated by the following equations:

$$Ni_{eq} = \%\ Ni + \%\ Co + 30(\%\ C) + 25(\%\ N) + 0.5(\%\ Mn) + 0.3(\%\ Cu) \quad (2)$$

$$Cr_{eq} = \%\ Cr + 2\%\ Si + 1.5(\%\ Mo) + 5(\%\ V) + 5.5(\%\ Al) + 1.75(\%\ Nb) + 1.5(\%\ Ti) + 0.75(\%\ W) \quad (3)$$

Figure 5:
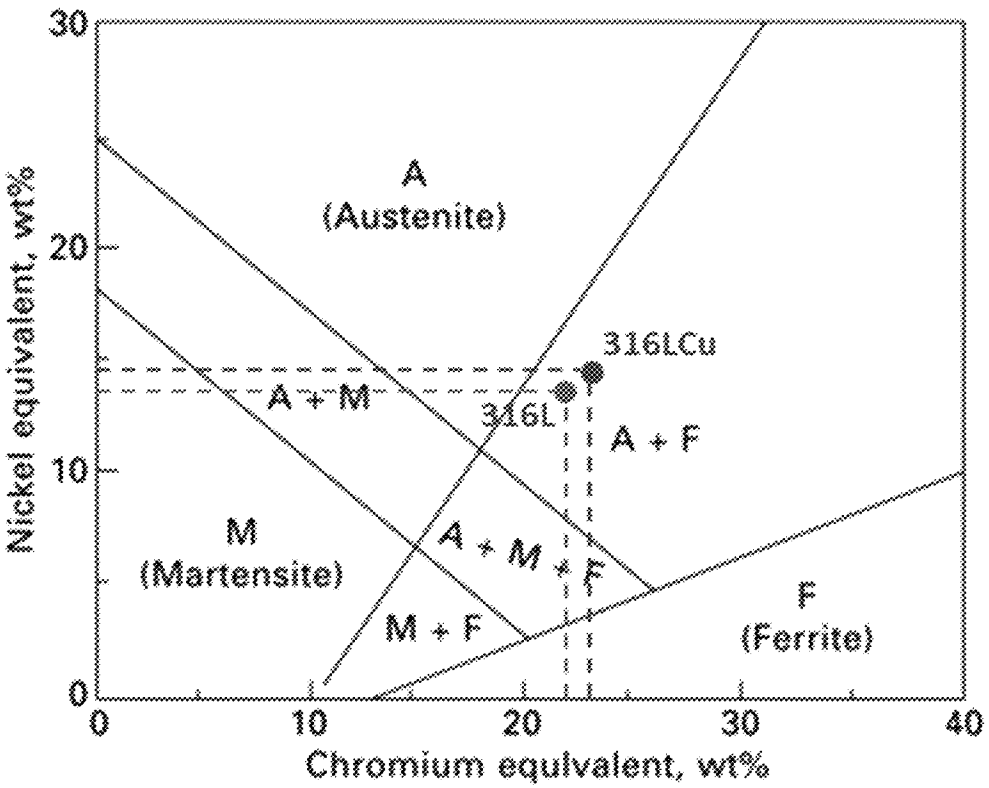
FIG. 5 shows a Nickel equivalent ($Ni_{eq}$)—Chromium equivalent ($Cr_{eq}$) phase diagram.

Considering the chemical composition mentioned in Table 1, the Ni and Cr equivalents for 316L and 316LCu alloys are Nieq 316L=13.6, Creq 316L=22.31, Nieq 316LCu=14.608, and Creq 316LCu=22.75, as located in the austenite-ferrite region of the Nieq-Creq diagram of FIG. 5.

According to the obtained Nieq and Creq, both 316L and 316L Cu alloy correspond to a non-expected α' region. However, BCC ferrite is linked to BCC martensite in thermodynamics calculations. Besides, the expected SFE of the 316L (~64 mJ $m^{-2}$) is above the SFE that commonly promotes γ to α' transformation (below 20 mJ $m^{-2}$) in SS. Moreover, the Cu addition is expected to further increase the SFE of the 316LCu alloy. Due to the above, the α' phase is usually not stable in 316L SS, specially at high temperatures. In one embodiment, a decrement from 26.4% to less than 1% of α' phase in cold rolled and annealed at 750° C. 316L SS.

Figure 6A:
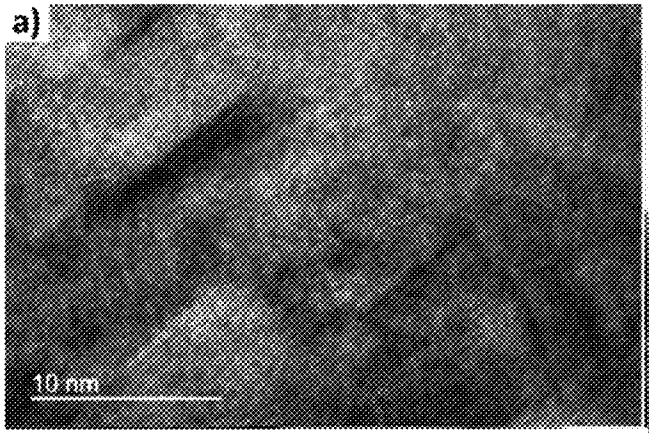
FIGS. 6A to 6D show defects on the H&ASSs: a) stacking faults, b) nanograins, c) nanotwins, d) nanolamellas, respectively.
Figure 6B:
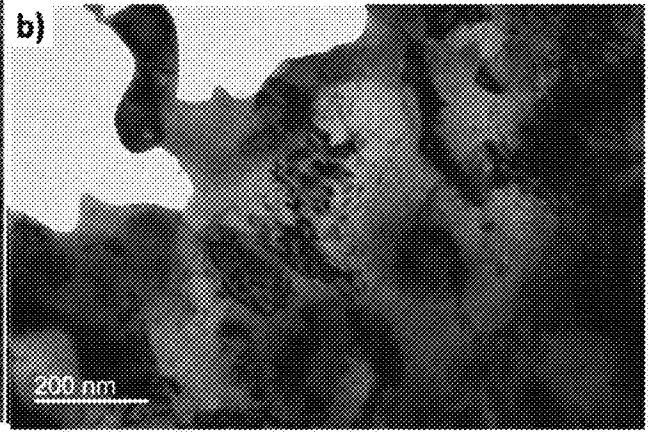
Figure 6C:
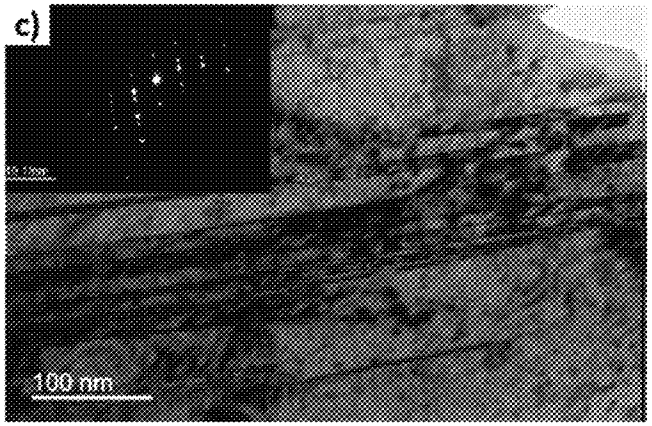
Figure 6D:
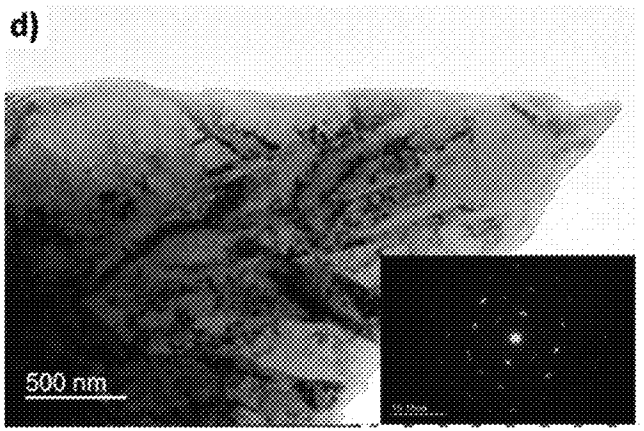
Figure 6E:
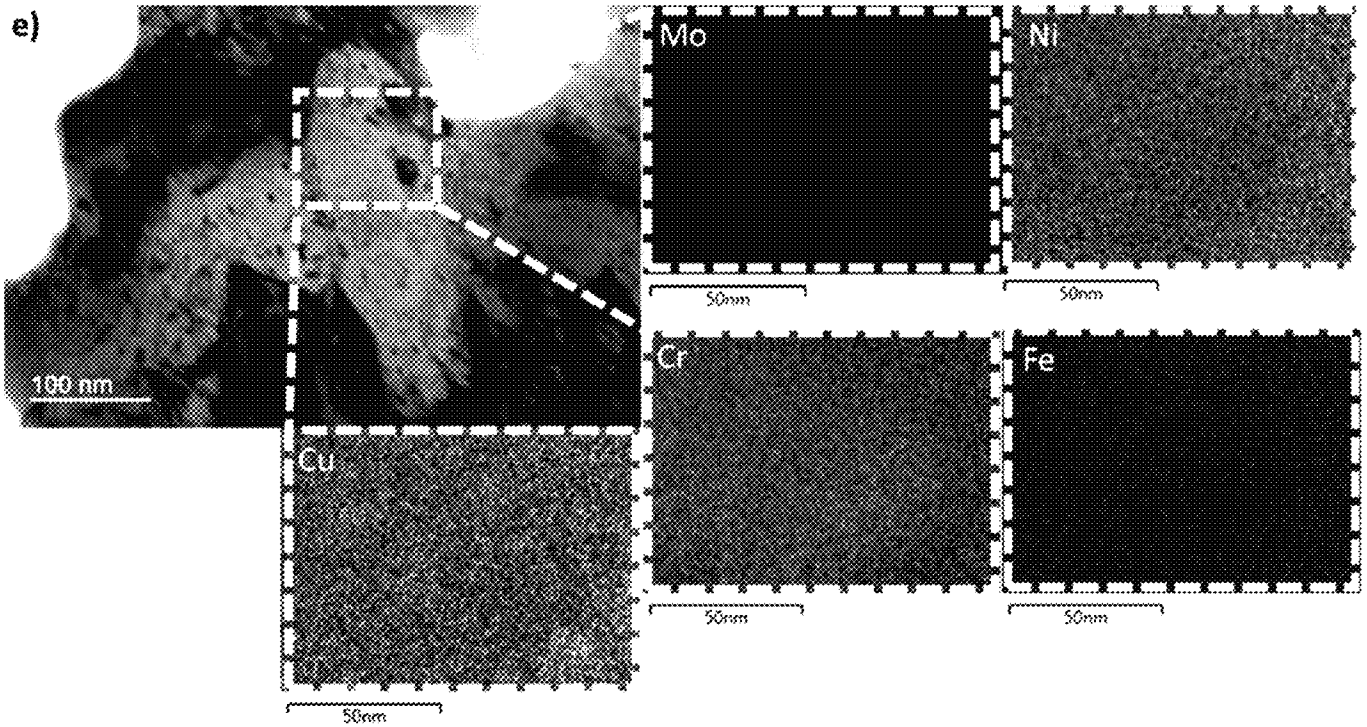
FIG. 6E show Cu nanoparticles in the heterostructure SS with chemical mapping by EDS.
Figure 7A:
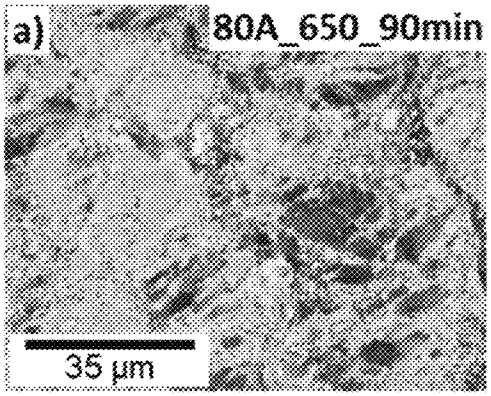
FIGS. 7A to 7D are EBSD micrographs that show grain distribution in samples 80A_650_90 min, 80A_750_600 s, 80S_650_90 min and 80S_750_600 s.
Figure 7B:
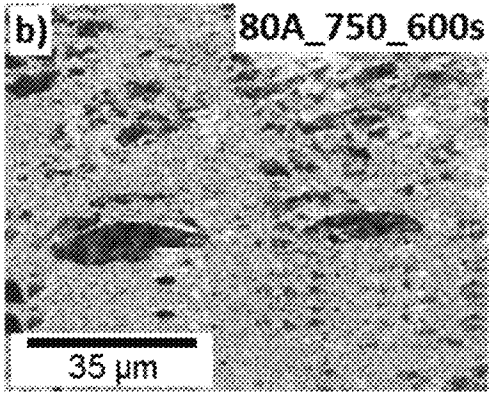
Figure 7C:
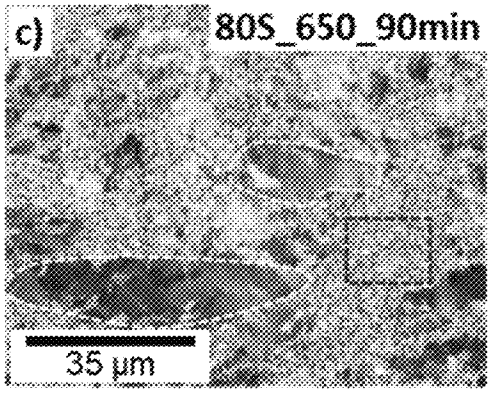
Figure 7D:
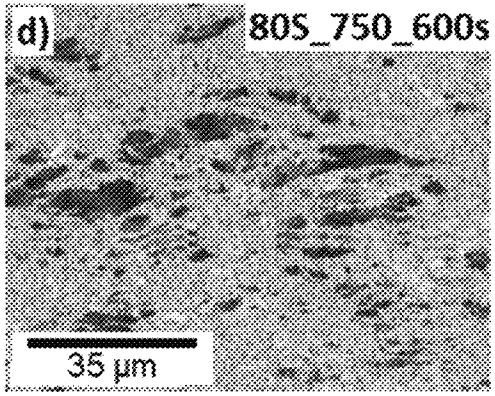
Figure 8B:
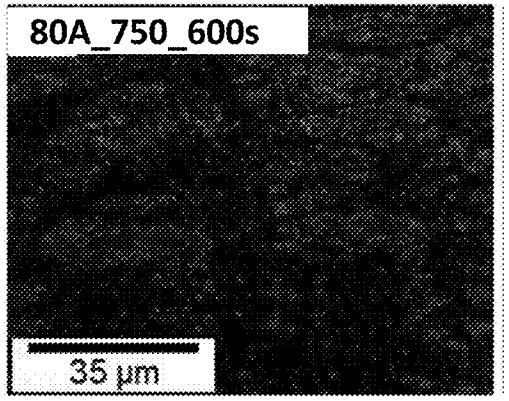
FIGS. 8A to 8D are EBSD micrographs that show GND pile-ups distribution in samples 80A_650_90 min, 80A_750_600 s, 80S_650_90 min and 80S_750_600 s.
Figure 8A:
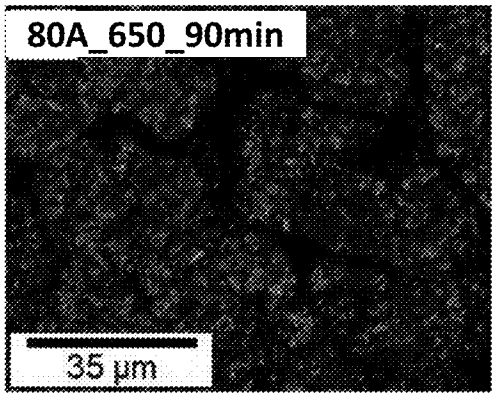
Figure 8D:
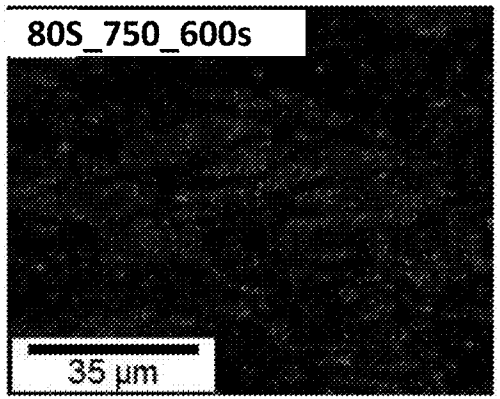
Figure 8C:
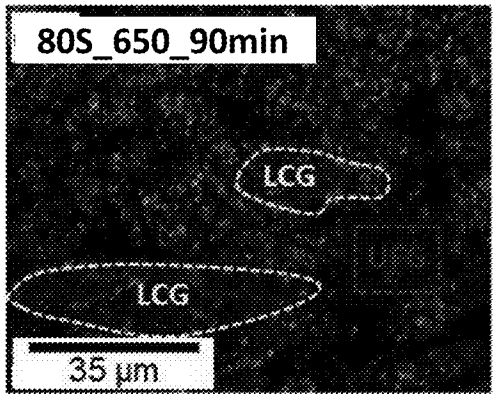

FIGS. 6A to 6D show defects on the H&ASSs: a) stacking faults, b) nanograins, c) nanotwins, d) nanolamellas, respectively. FIG. 6E show Cu nanoparticles in the heterostructure SS with chemical mapping by EDS. TEM micrographs were insert in FIGS. 6C to 6D to observe some formed defects. The main observed defects are dislocation tangles, nanotwins, nano-lamellas within grains, and shear bands.

FIGS. 7A to 7D are EBSD micrographs that show grain distribution and FIGS. 8A to 8D are EBSD micrographs that show GND pile-ups distribution in samples 80A_650_90 min, 80A_750_600s, 80S_650_90 min and 80S_750_600 s, which are selected as representative of the four thermomechanical routes R1 to R4, respectively. The homogeneous 316L and 316LCu samples show equiaxed micrometric grains and significant amount of twins. The H&ASS samples shown micrometric and fine grain colonies.

EDS analyses shown Cu precipitates in both 316LCu and H&ASS samples. Those precipitates could be expected from the aging heat treatment and the low solubility of Cu in the Fe matrix, which can also be observed in the binary diagram phase.

For grain morphology and GND estimations, the H&ASS samples are constituted by ultrafine grains (UFG) and lamellar coarse grains (LCG), i.e., forming heterostructured lamella structure (HLS) arrangements. From the grain size differences and grain distribution, it can be observed that softer elongated LCG are surrounded by harder UFG zones.

The mutual constraining and high mechanical mismatch between soft and hard regions are essential features for activating substantial HDI strengthening. Referring back to FIGS. 2A to 2C, hardness differences higher than 100% can be expected among the fine grained 80% CR condition (360 to 368 HVN0.5) and coarse-grained SSol or A conditions (135 to 148 HVN0.5). In other words, the H&ASS will improve the mechanical behavior of conventional SS and existing antimicrobial SS.

The four routes R1 to R4 followed similar microstructural evolution paths at different kinetics encouraged by different temperatures. Shear bands (SBs) and twinning are formed during CR processes in low-SFE materials, such as 316L SS. SIM occurrence (as shown in FIG. 4A) is encouraged by the presence of SBs and twins acting as nucleation sites. Fine UFG or nanometric regions are then formed by i) shear fracture micro-twins and γ phase within shear bands resulting in nano-twin and nano-lamellas, and ii) dislocation accumulation at twin boundaries, generating nano-twin bundles (as observed in FIGS. 6A to 6D)

During annealing, reversion process, i.e., α' to γ phase transformation, may occur. From the Cr/Ni ratio of ~1.4, the heating rate of about 40° C. $s^{-1}$, and the high density of GND pile-ups after annealing or aging, shear reversion may occur. Due to the lower energy of twin boundaries compared to that of grain or SBs boundaries, the reversion during annealing starts at the SBs and nanograined zones followed by the nano-twinned regions. As a result, H&ASSs are conformed by nano-twins, nano-grains, LCG, and recrystallised grains embedded in an γ-matrix. With these microstructures, the H&ASSs combine multiple strengthening mechanisms, which will be described in more details below.

Mechanical Behavior Evaluation

Figure 9:
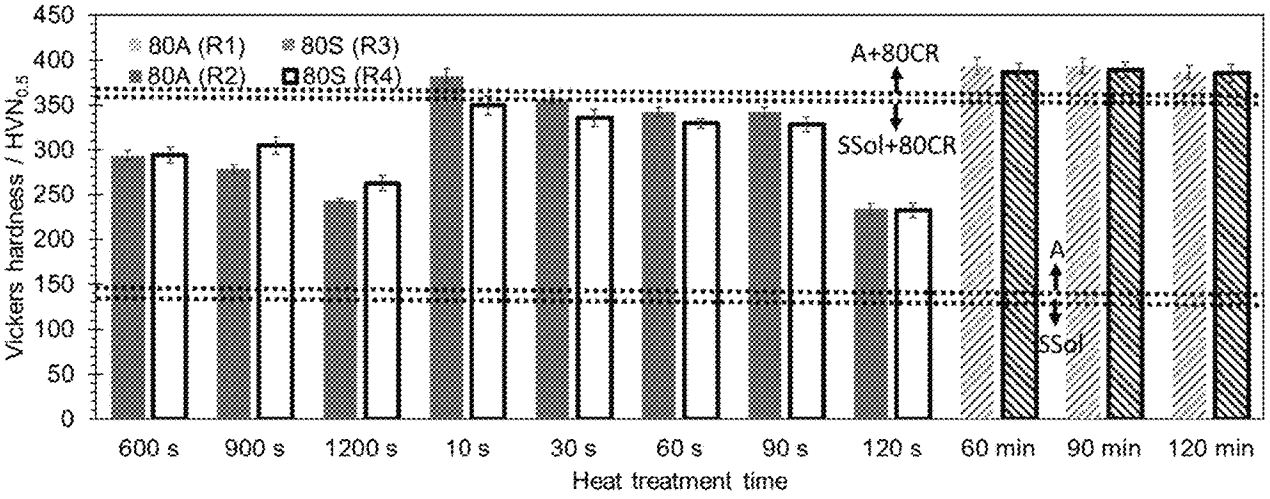
FIG. 9 shows comparison of hardness for the 80A and 80S series of H&ASSs obtained through the four thermo-mechanical routes.
Figure 10:
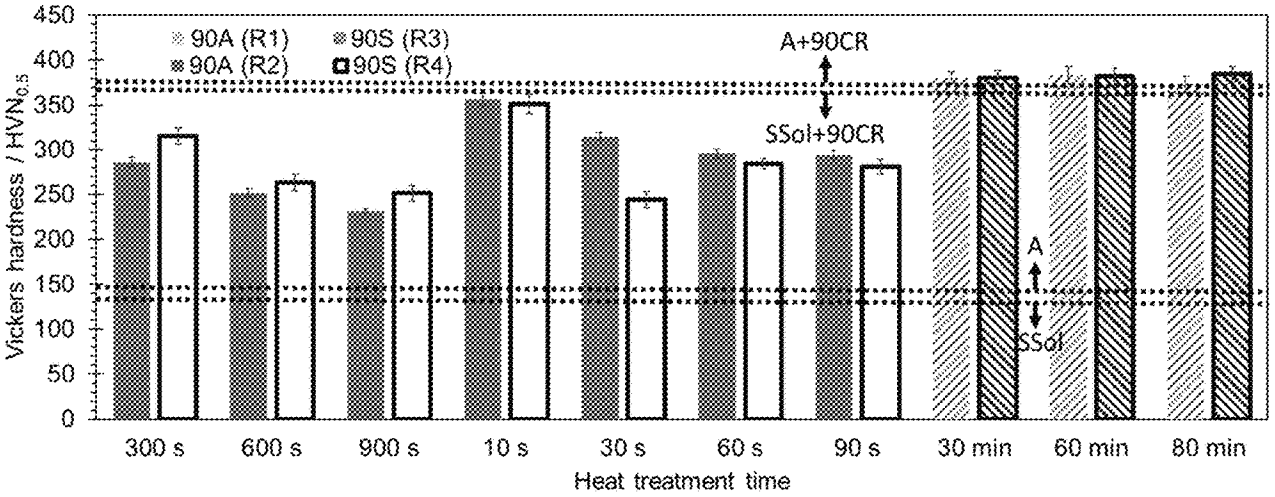
FIG. 10 shows comparison of hardness for the 90A and 90S series of H&ASSs obtained through the four thermo-mechanical routes.
Figure 11A:
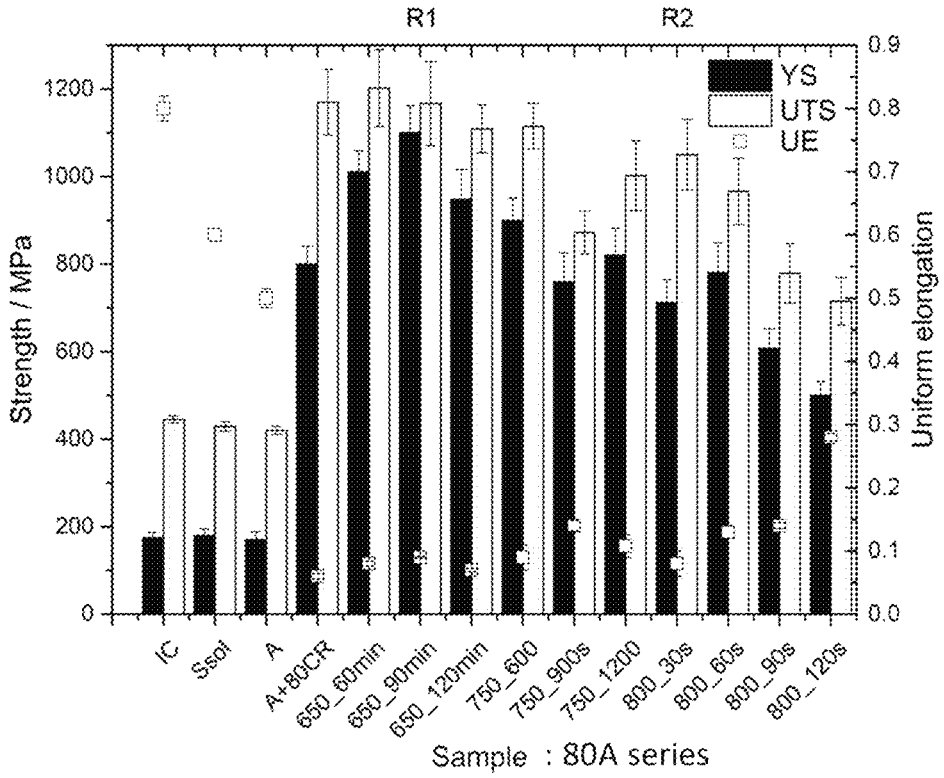
FIGS. 11A to 11D show results from tensile tests measurements on the 80A, 80S, 90A and 90S series respectively produced through the four thermo-mechanical routes.
Figure 11B:
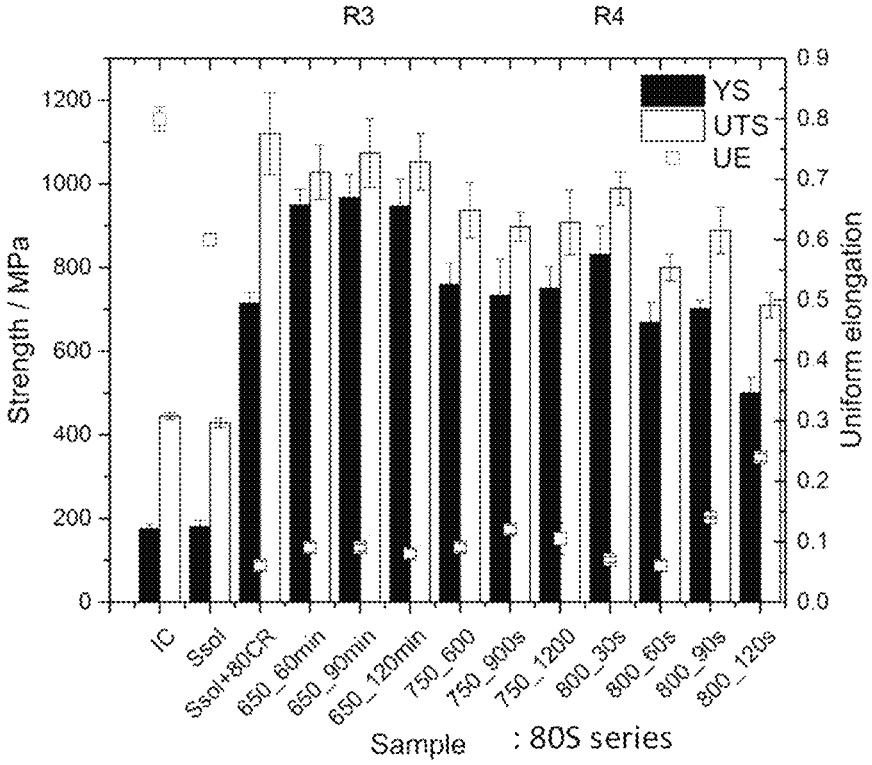
Figure 11C:
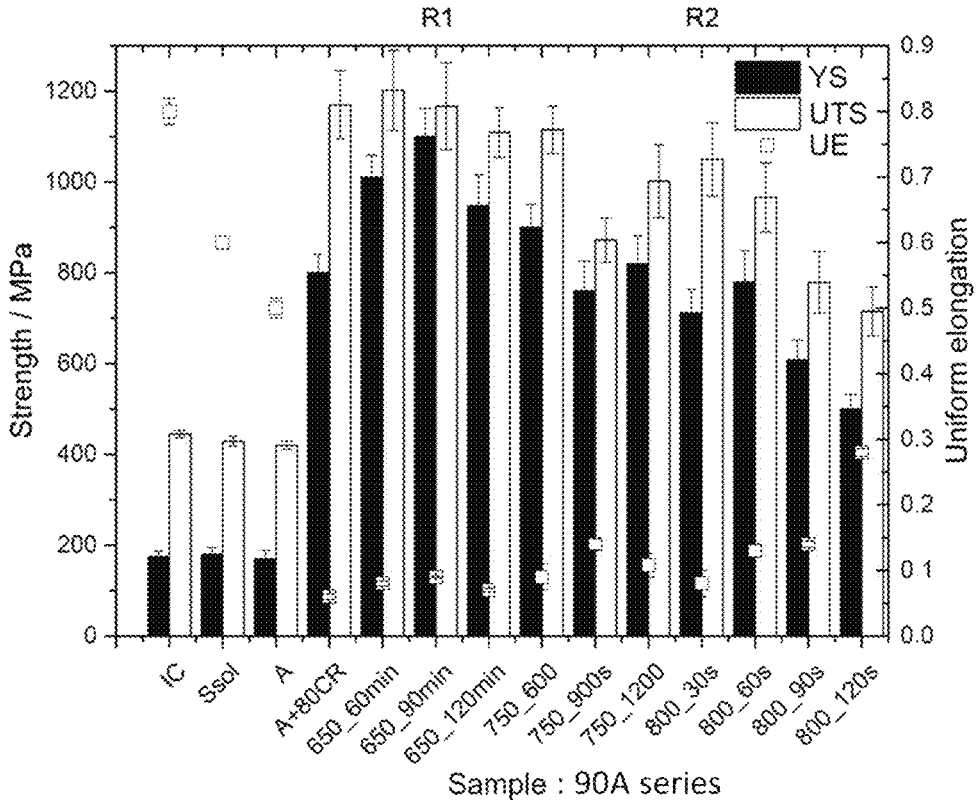
Figure 11D:
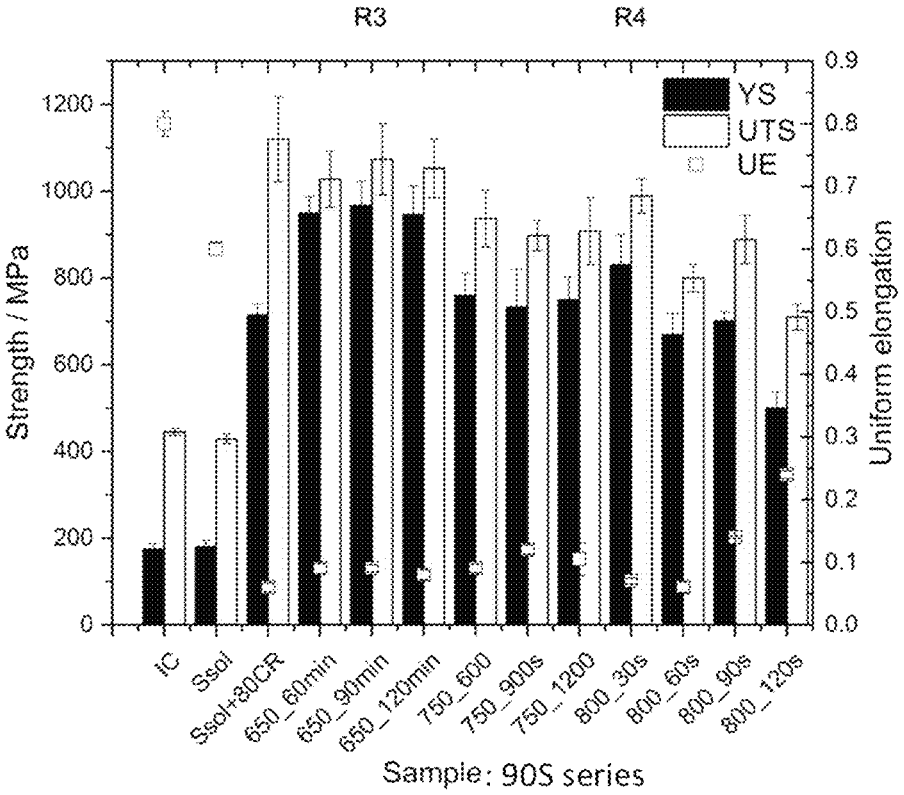

FIG. 9 shows comparison of hardness for the 80A and 80S series of H&ASSs obtained through the four thermo-mechanical routes (R1 to R4), and the hardness of homogeneous samples obtained under coarse-grained conditions (A and SSol) and fine-grained conditions (A+80CR and SSol+80CR) are also shown for comparison. FIG. 10 shows comparison of hardness for the 90A and 90S series of H&ASSs obtained through the four thermo-mechanical routes (R1 to R4) and the hardness of homogeneous samples obtained under coarse-grained conditions (A and SSol) and fine-grained conditions (A+90CR and SSol+90CR) are also shown for comparison.

It can be seen that similar tendency occurred for the 80A, 80S, 90A and 90S series. The difference in hardness might be related to the copper particles dispersion due to the last aging stage.

FIGS. 11A to 11D show results from tensile tests measurements on the 80A, 80S, 90A and 90S series respectively produced through the four thermo-mechanical routes (R1 to R4). The results from tensile tests measurements include yield strength (YS), ultimate tensile strength (UTS), and uniform elongation (UE).

The higher UTS in samples processed through the R1 and R3 routes agreed with their higher hardness shown in FIGS. 9 and 10. The efficiency of the processing routes for decreasing the strength to ductility trade-off of conventional 316L SS can be ordered as follows: R3>R1>R2>R4.

Figure 12:
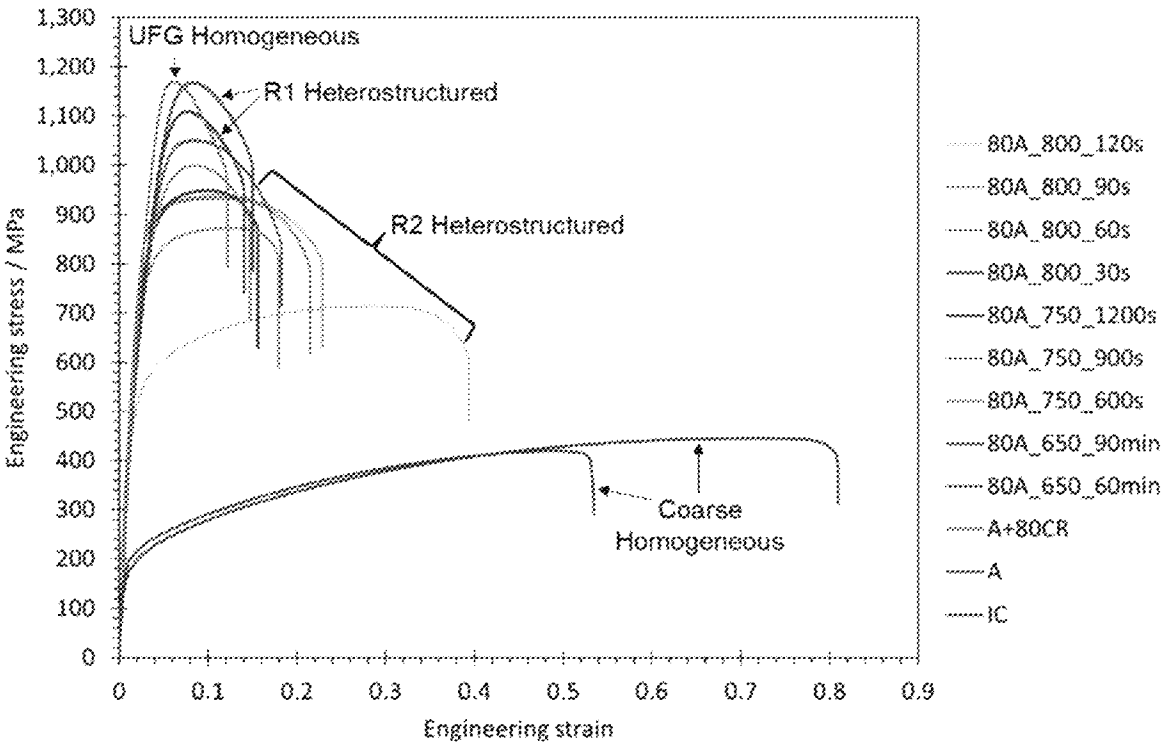
FIG. 12 shows tensile engineering stress-strain curves of the 80A series produced through different thermo-mechanical routes.

FIG. 12 shows tensile engineering stress-strain curves of the 80A series, including homogeneous as-received (IC), aged (A) and A+80% cold rolling (CR) samples, as well as H&ASS produced through different thermo-mechanical routes. The 80A series are representative of the 80S, 90S, and 90A series behavior. However, after 80CR, the samples got a higher hardness and strength, being the reason of their selection.

Figure 13:
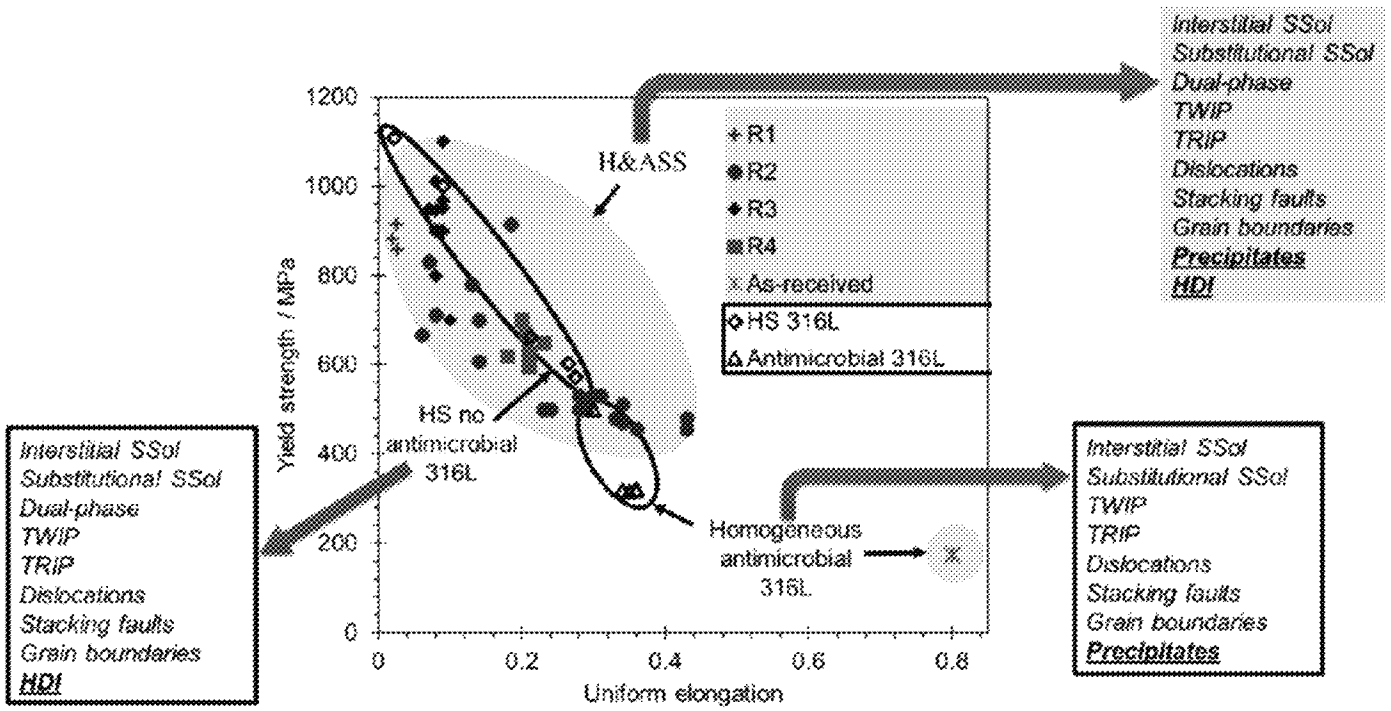
FIG. 13 shows correlation between yield strength and uniform elongation for various SS and H&ASS samples.

FIG. 13 shows correlation between yield strength and uniform elongation for various SS samples, including homogeneous antimicrobial 316L, no antimicrobial 316L and the H&ASS. The strengthening mechanisms associated to every class of materials were included for comparison purposes.

From the defects and microstructural arrangements shown above, all the available strengthening mechanisms are expected to be activated in the H&ASSs provided by the present disclosure. The strengthening mechanisms may include but not limited to, interstitial SSol, substitutional SSol, multi-phase, TWIP, TRIP, dislocations, stacking faults, grain boundaries, precipitates, and HDI.

Table 3 shows average mechanical properties of the homogeneous 316LCu SS (as reference materials) and the H&ASSs samples produced by different thermo-mechanical routes (R1 to R4) according to various embodiments of the present invention. It can be seen that the provided H&ASSs have a highest YS of 1100 MPa, which is around six times of the 175 MPa YS of the homogeneous 316LCu SS, while the ductility remains adequate for manufacturing purposes.

TABLE 3

Average mechanical properties of the homogeneous 316LCu SS and H&ASSs samples produced through thermo-mechanical routes R1 to R4

| Sample | Group | YS | ±STD | UTS | ±STD | UE | ±STD | FE | ±STD | $HVN_{0.5}$ | ±STD |
|---|---|---|---|---|---|---|---|---|---|---|---|
| IC | Homogeneous | 175 | 12.00 | 445 | 8.00 | 0.80 | 0.02 | 0.81 | 0.07 | 143.84 | 3.23 |
| Ssol | Homogeneous | 180 | 15.00 | 429 | 11.00 | 0.60 | 0.01 | 0.70 | 0.06 | 135.67 | 4.20 |
| A | Homogeneous | 170 | 19.00 | 420 | 9.00 | 0.50 | 0.02 | 0.55 | 0.05 | 148.63 | 5.59 |
| A + 80CR | Homogeneous | 800 | 41.00 | 1170 | 75.00 | 0.06 | 0.00 | 0.12 | 0.01 | 368.65 | 6.93 |
| SSol + 80CR | Homogeneous | 715 | 25.00 | 1120 | 98.00 | 0.06 | 0.01 | 0.13 | 0.01 | 360.22 | 7.48 |
| A + 90CR | Homogeneous | 1010 | 40.00 | 1200 | 35.00 | 0.04 | 0.00 | 0.09 | 0.01 | 377.00 | 3.65 |
| SSol + 90CR | Homogeneous | 941 | 46.00 | 1148 | 97.00 | 0.04 | 0.01 | 0.07 | 0.01 | 368.32 | 7.57 |
| 80A_650_60 min | H&ASS - R1 | 1011 | 48.00 | 1202 | 88.00 | 0.08 | 0.00 | 0.14 | 0.01 | 393.25 | 9.39 |
| 80A_650_90 min | H&ASS - R1 | 1100 | 62.00 | 1167 | 96.00 | 0.09 | 0.00 | 0.15 | 0.01 | 393.53 | 8.98 |
| 80A_650_120 min | H&ASS - R1 | 948 | 68.00 | 1109 | 55.00 | 0.08 | 0.00 | 0.14 | 0.01 | 386.60 | 7.30 |
| 80A_750_600 | H&ASS - R1 | 900 | 51.00 | 1115 | 52.00 | 0.09 | 0.02 | 0.14 | 0.01 | 293.71 | 5.42 |
| 80A_750_900 s | H&ASS - R2 | 760 | 66.00 | 872 | 49.00 | 0.14 | 0.01 | 0.18 | 0.02 | 278.40 | 5.09 |
| 80A_750_1200 | H&ASS - R2 | 820 | 62.00 | 1002 | 80.00 | 0.11 | 0.02 | 0.16 | 0.02 | 243.09 | 2.10 |
| 80A_800_30 s | H&ASS - R2 | 712 | 52.00 | 1050 | 81.00 | 0.08 | 0.02 | 0.18 | 0.02 | 356.22 | 4.62 |
| 80A_800_60 s | H&ASS - R2 | 780 | 69.00 | 966 | 76.00 | 0.13 | 0.01 | 0.22 | 0.02 | 342.09 | 5.37 |
| 80A_800_90 s | H&ASS - R2 | 608 | 44.00 | 779 | 68.00 | 0.14 | 0.00 | 0.21 | 0.02 | 342.13 | 5.03 |
| 80A_800_120 s | H&ASS - R2 | 500 | 32.00 | 715 | 54.00 | 0.28 | 0.01 | 0.38 | 0.03 | 233.68 | 6.22 |
| 80S_650_60 min | H&ASS - R3 | 950 | 38.00 | 1028 | 65.00 | 0.09 | 0.01 | 0.18 | 0.02 | 386.51 | 9.62 |
| 80S_650_90 min | H&ASS - R3 | 968 | 55.00 | 1074 | 82.00 | 0.09 | 0.01 | 0.19 | 0.02 | 388.95 | 8.98 |

TABLE 3-continued

Average mechanical properties of the homogeneous 316LCu SS and H&ASSs samples produced through thermo-mechanical routes R1 to R4

| Sample | Group | YS | ±STD | UTS | ±STD | UE | ±STD | FE | ±STD | $HVN_{0.5}$ | ±STD |
|---|---|---|---|---|---|---|---|---|---|---|---|
| 80S_650_120 min | H&ASS - R3 | 946 | 66.00 | 1053 | 68.00 | 0.08 | 0.01 | 0.20 | 0.02 | 385.51 | 9.62 |
| 80S_750_600 | H&ASS - R4 | 760 | 51.00 | 937 | 66.00 | 0.09 | 0.01 | 0.18 | 0.02 | 294.32 | 8.87 |
| 80S_750_900 s | H&ASS - R4 | 733 | 88.00 | 898 | 35.00 | 0.12 | 0.01 | 0.16 | 0.01 | 304.89 | 9.27 |
| 80S_750_1200 | H&ASS - R4 | 750 | 53.00 | 908 | 78.00 | 0.11 | 0.03 | 0.17 | 0.01 | 262.34 | 8.80 |
| 80S_800_30 s | H&ASS - R4 | 831 | 69.00 | 989 | 40.00 | 0.07 | 0.00 | 0.02 | 0.00 | 335.74 | 9.42 |
| 80S_800_60 s | H&ASS - R4 | 669 | 48.00 | 800 | 32.00 | 0.06 | 0.01 | 0.15 | 0.01 | 329.80 | 5.60 |
| 80S_800_90 s | H&ASS - R4 | 701 | 21.00 | 889 | 56.00 | 0.14 | 0.00 | 0.23 | 0.02 | 328.17 | 8.24 |
| 80S_800_120 s | H&ASS - R4 | 500 | 38.00 | 710 | 30.00 | 0.24 | 0.01 | 0.29 | 0.03 | 232.34 | 8.07 |
| 90A_650_30 min | H&ASS - R1 | 900 | 48.00 | 1100 | 61.00 | 0.09 | 0.00 | 0.15 | 0.01 | 380.76 | 4.41 |
| 90A_650_60 min | H&ASS - R1 | 900 | 31.00 | 1100 | 58.00 | 0.08 | 0.01 | 0.12 | 0.01 | 383.52 | 3.60 |
| 90A_650_80 min | H&ASS - R1 | 800 | 21.00 | 1000 | 65.00 | 0.08 | 0.00 | 0.11 | 0.02 | 372.79 | 3.58 |
| 90A_750_300 s | H&ASS - R2 | 500 | 14.00 | 780 | 88.00 | 0.23 | 0.01 | 0.25 | 0.02 | 285.79 | 8.81 |
| 90A_750_600 s | H&ASS - R2 | 500 | 18.00 | 730 | 55.00 | 0.29 | 0.01 | 0.31 | 0.03 | 251.60 | 5.45 |
| 90A_750_900 s | H&ASS - R2 | 500 | 15.00 | 715 | 48.00 | 0.28 | 0.01 | 0.29 | 0.03 | 231.70 | 4.84 |
| 90A_800_30 s | H&ASS - R2 | 510 | 18.00 | 710 | 42.00 | 0.34 | 0.01 | 0.36 | 0.04 | 315.17 | 8.70 |
| 90A_800_60 s | H&ASS - R2 | 480 | 29.00 | 700 | 59.00 | 0.33 | 0.01 | 0.34 | 0.03 | 295.28 | 10.67 |
| 90A_800_90 s | H&ASS - R2 | 470 | 31.00 | 670 | 57.00 | 0.34 | 0.01 | 0.35 | 0.03 | 293.85 | 8.58 |
| 90S_650_30 min | H&ASS - R3 | 900 | 57.00 | 1080 | 81.00 | 0.09 | 0.01 | 0.14 | 0.01 | 380.80 | 2.51 |
| 90S_650_60 min | H&ASS - R3 | 900 | 42.00 | 1100 | 62.00 | 0.09 | 0.00 | 0.13 | 0.02 | 381.97 | 3.10 |
| 90S_650_80 min | H&ASS - R3 | 700 | 68.00 | 1125 | 56.00 | 0.10 | 0.00 | 0.15 | 0.01 | 384.23 | 3.76 |
| 90S_750_300 s | H&ASS - R4 | 530 | 49.00 | 760 | 46.00 | 0.28 | 0.09 | 0.30 | 0.03 | 315.50 | 8.36 |
| 90S_750_600 s | H&ASS - R4 | 530 | 39.00 | 745 | 69.00 | 0.30 | 0.00 | 0.31 | 0.04 | 263.33 | 8.70 |
| 90S_750_900 s | H&ASS - R4 | 530 | 51.00 | 775 | 65.00 | 0.31 | 0.01 | 0.32 | 0.03 | 251.48 | 6.88 |
| 90S_800_30 s | H&ASS - R4 | 480 | 34.00 | 675 | 52.00 | 0.43 | 0.02 | 0.48 | 0.04 | 244.18 | 12.91 |
| 90S_800_60 s | H&ASS - R4 | 455 | 28.00 | 665 | 54.00 | 0.43 | 0.01 | 0.49 | 0.06 | 283.82 | 8.24 |
| 90S_800_90 s | H&ASS - R4 | 455 | 18.00 | 660 | 59.00 | 0.36 | 0.03 | 0.41 | 0.04 | 280.89 | 8.11 |

YS = Held strength, UTS = Ultimate tensile strength, UE = uniform elongation, FE = Final elongation, $HVN_{0.5}$ = Vickers hardness with load of 500 g, and STD = standard deviation.

Antibacterial Assessment

Figure 14:
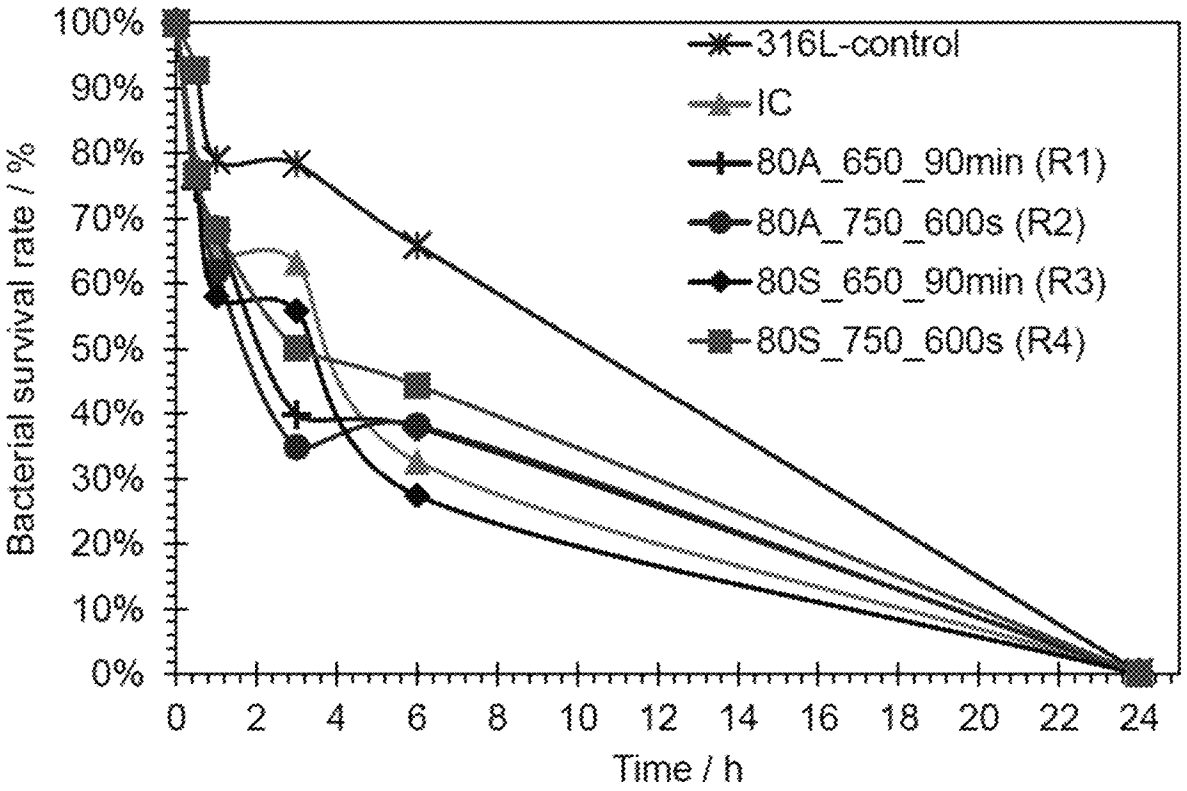
FIG. 14 shows bacterial survival rate of a Cu-free control sample and a Cu-bearing homogeneous, and various H&ASS samples subjected to the plate counting method.

To probe the antibacterial efficacy of the H&ASSs provided by the present invention, the best mechanically performed materials (80A_650_90 min, 80A_750_600 s, 80S_650_90 min, and 80S_750_600 s) were subjected to a plate counting method using *Escherichia coli* (*E. coli*) bacteria. FIG. 14 shows bacterial survival rate of a Cu-free control sample (316L control) and a Cu-bearing homogeneous (IC), and H&ASS samples (80A_650_90 min, 80A_750_600 s, 80S_650_90 min, and 80S_750_600 s) subjected to the plate counting method.

Figure 15:
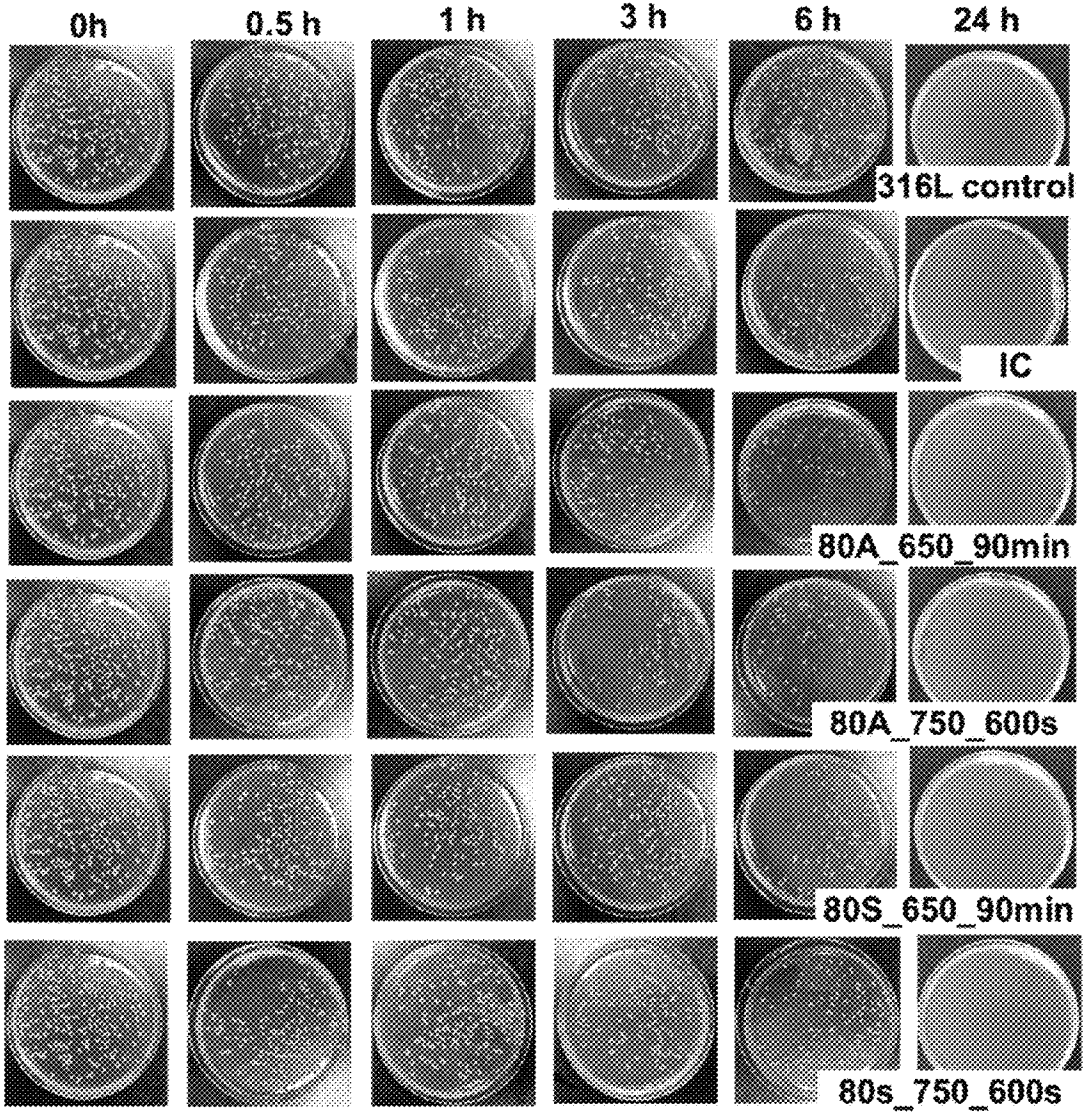
FIG. 15 shows photographs of the *E. Coli* bacteria colonies on the agar plates for a Cu-free control sample and a Cu-bearing homogeneous, and various H&ASS samples subjected to the plate counting method.

The bacterial survival rate decreased more sharply and is at least 14% higher in the Cu-bearing samples (i.e., the homogeneous IC and the four H&ASS samples) with respect to the Cu-free control sample (i.e., 316L control). At 6-hours testing, the bacterial survival rate is of 65.9% for the Cu-free control sample and from 27 to 44% in the Cu-bearing samples. In all cases, the survival rate reaches to nearly 0% after 24 hours testing. Photographs of the *E. Coli* bacteria colonies on the agar plates are shown in FIG. 15.

No significant change was observed between the homogeneous IC and HS Cu-bearing (H&ASS) samples against *E. Coli* bacteria survival. This result might indicate that the bacterial survival rate has a low sensitivity to the microstructural changes between the IC and the H&ASSs samples. The low bacterial rate sensitivity to the microstructure might be related to the nearly homogeneous elemental chemical distribution shown in FIG. 6E. Bacterial adhesion in SS is especially sensitive to surface carbides (sensitized SS) compared to annealed and oxidized SS.

On the other hand, higher grain boundary length on SS, such as in the H&ASSs compared to IC, is expected to increase the surface reactivity and promote ion release and cell interaction. The release of $Cu^{2+}$ from Cu-bearing 316L SS has been proven as poisoning for bacteria. However, small grain size also promotes a more compacted surface oxide layer, decreasing the degradation (corrosion) of the material. It is possible that both mechanisms acted simultaneously in the H&ASSs.

A slight bacterial increment can be observed for the control, IC and 80S_650_90 min samples. Those increments might be related to the phosphates content ($Na_2HPO_4$ and $KH_2PO_4$) in the PBS solution, which have been reported for delaying the survival of *E. coli*.

The embodiments may be chosen and described in order to best explain the principles of the invention and its practical application, thereby enabling others skilled in the art to understand the invention for various embodiments and with various modifications that are suited to the particular use contemplated. While the methods disclosed herein have been described with reference to particular operations performed in a particular order, it will be understood that these operations may be combined, sub-divided, or re-ordered to form an equivalent method without departing from the teachings of the present disclosure. Accordingly, unless specifically indicated herein, the order and grouping of the operations are not limitations. While the apparatuses disclosed herein have been described with reference to particular structures, shapes, materials, composition of matter and relationships . . . etc., these descriptions and illustrations are not limiting. Modifications may be made to adapt a particular situation to the objective, spirit and scope of the present disclosure. All such modifications are intended to be within the scope of the claims appended hereto.

The invention claimed is:

1. A method for synthesizing a heterostructured antimicrobial stainless steel with improved yield strength and reduced strength-to-ductility trade-off, having a heterostructured lamella structure arrangement formed with lamellar coarse grains surrounded by ultrafine grains; and a plurality of defects activating multiple strengthening mechanisms including: interstitial solid solution alloying elements; substitutional solid solution alloying elements; twins; multiphasic interfaces formed with face-centered cubic austenite phase and body-centered cubic martensite phase; statistically stored dislocations; strain-induced phase transformation, geometrically necessary dislocations pile-ups; stacking faults; precipitates; high density of grain boundaries, and hetero-deformation induced strengthening, the method comprising:

a) casting a starting alloy with addition of antimicrobial element;

b) subjecting the starting alloy to solid solution treatment to form a solid solution;

c) quenching the solid solution to form a solid-solution treated stainless steel;

d) subjecting the solid-solution treated stainless steel to aging to form an aged stainless steel;

e) subjecting the aged stainless steel to cold rolling to form a cold-rolled stainless steel;

f) subjecting the cold-rolled stainless steel to a final heat treatment to form the heterostructured antimicrobial stainless steel.

2. The method according to claim 1, wherein in step b), the solid solution treatment is performed at 1050° C. for a processing time in a range from 30 to 120 minutes.

3. The method according to claim 1, wherein in step d), the aging is performed at an aging temperature in a range from 550° C. to 700° C. for an aging time in a range from 30 to 360 minutes.

4. The method according to claim 1, wherein in step e), a thickness of the aged stainless steel is reduced for a range from 60% to 80% by cold rolling.

5. The method according to claim 1, wherein in step f), the final heat treatment is performed with a heating rate of 40° C. $s^{-1}$.

6. The method according to claim 5, wherein in step f), the final heat treatment is a posterior aging treatment.

7. The method according to claim 6, wherein the posterior aging treatment is performed at an aging temperature in a range from 500 to 650° C. for an aging time in a range from 30 to 90 minutes.

8. The method according to claim 1, wherein in step f), the final heat treatment is an annealing treatment.

9. The method according to claim 8, wherein the annealing treatment is performed at an annealing temperature in a range from 700 to 800° C. for an annealing time in a range from 30 to 900 seconds.

10. The method according to claim 1, wherein the starting alloy has a nominal chemical composition of Cu in 0.01-0.08 wt. %, Ni in 3.00-14.00 wt. %, Cr in 7.00-20.00 wt. %, Mo≤3.00 wt. %, Mn≤2.00 wt. %, Si≤1.00 wt. %, balanced Fe, and addition of antimicrobial element ≤5.00 wt. %; and the antimicrobial element is Cu, Zn or Ag.

11. A method for synthesizing a heterostructured antimicrobial stainless steel with improved yield strength and reduced strength-to-ductility trade-off, having a heterostructured lamella structure arrangement formed with lamellar coarse grains surrounded by ultrafine grains; and a plurality of defects activating multiple strengthening mechanisms including: interstitial solid solution alloying elements; substitutional solid solution alloying elements; twins; multiphasic interfaces formed with face-centered cubic austenite phase and body-centered cubic martensite phase; statistically stored dislocations; strain-induced phase transformation, geometrically necessary dislocations pile-ups; stacking faults; precipitates; high density of grain boundaries, and hetero-deformation induced strengthening, the method comprising:

a) casting a starting alloy with addition of antimicrobial element;

b) subjecting the starting alloy to solid solution treatment to form a solid solution;

c) quenching the solid solution to form a solid-solution treated stainless steel;

d) subjecting the solid-solution treated stainless steel to cold rolling to form a cold-rolled stainless steel;

e) subjecting the cold-rolled stainless steel to a final heat treatment to form the heterostructured antimicrobial stainless steel.

12. The method according to claim 11, wherein in step b), the solid solution treatment is performed at 1050° C. for a processing time in a range from 30 to 120 minutes.

13. The method according to claim 11, wherein in step d), a thickness of the solid-solution treated stainless steel is reduced for a range from 60% to 80% by cold rolling.

14. The method according to claim 11, wherein in step e), the final heat treatment is performed under a heating rate of 40° C. $s^{-1}$.

15. The method according to claim 11, wherein in step e), the final heat treatment is an aging treatment.

16. The method according to claim 15, wherein the aging treatment is performed at an aging temperature in a range from 500 to 650° C. for an aging time in a range from 30 to 90 minutes.

17. The method according to claim 11, wherein in step e), the final heat treatment is an annealing treatment.

18. The method according to claim 17, wherein the annealing treatment is performed at an annealing temperature in a range from 700 to 800° C. for an annealing time in a range from 30 to 900 seconds.

19. The method according to claim 11, wherein the starting alloy has a nominal chemical composition of Cu in 0.01-0.08 wt. %, Ni in 3.00-14.00 wt. %, Cr in 7.00-20.00 wt. %, Mo≤3.00 wt. %, Mn≤2.00 wt. %, Si≤1.00 wt. %, balanced Fe, and addition of antimicrobial element ≤5.00 wt. %; and the antimicrobial element is Cu, Zn or Ag.

* * * * *